US011168388B2

(12) United States Patent
Niedringhaus et al.

(10) Patent No.: US 11,168,388 B2
(45) **Date of Patent: *Nov. 9, 2021**

(54) METHOD AND APPARATUS FOR EXTENDING THE CAMPAIGN LIFE OF STABILIZERS FOR A COATING LINE

(71) Applicant: AK Steel Properties, Inc., West Chester, OH (US)

(72) Inventors: Joyce C. Niedringhaus, Liberty Township, OH (US); Daniel J. Cadotte, Middletown, OH (US); William F. Sersion, Jr., Middletown, OH (US); Tony Lee Webb, Hamilton, OH (US)

(73) Assignee: Cleveland-Cliffs Steel Properties Inc.

( * ) Notice: Subject to any disclaimer, the term of this patent is extended or adjusted under 35 U.S.C. 154(b) by 0 days.

This patent is subject to a terminal disclaimer.

(21) Appl. No.: 16/263,044

(22) Filed: Jan. 31, 2019

(65) Prior Publication Data

US 2019/0161842 A1 May 30, 2019

Related U.S. Application Data

(63) Continuation-in-part of application No. 15/583,450, filed on May 1, 2017.

(Continued)

(51) Int. Cl.
*C23C 2/00* (2006.01)
*C23C 2/40* (2006.01)

(52) U.S. Cl.
CPC ..... *C23C 2/003* (2013.01); *C23C 2/40* (2013.01)

(58) Field of Classification Search
CPC . C23C 2/00; C23C 2/003; C04B 35/18; F16C 13/02; F16C 33/043; F16C 33/26;
(Continued)

(56) References Cited

U.S. PATENT DOCUMENTS 117,985 A 8/1871 Collier
317,781 A 5/1885 Hemphill
(Continued)

FOREIGN PATENT DOCUMENTS

CN 204898045 U 12/2015
DE 102012103132 B3 5/2013
(Continued)

OTHER PUBLICATIONS

European Communication dated Dec. 6, 2018 for Application No. 17724668.3, 3 pgs.

(Continued)

*Primary Examiner* — Paul A Wartalowicz
*Assistant Examiner* — Ryan L Heckman
(74) *Attorney, Agent, or Firm* — Frost Brown Todd LLC

(57) ABSTRACT

A steel processing line includes a roller submerged in a quantity of molten metal. The roller includes two journals. Each journal is received by an opening defined by a roller sleeve having a ceramic or refractory material. The roller sleeve is disposed between each journal and a bearing block to reduce or prevent wear on the journal. An inner dimension of each roller sleeve and an outer dimension of each respective journal defines a clearance. The inner dimension of each roller sleeve and the outer dimension of each respective journal is configured such that the clearance persists as the roller and the pair of roller sleeves are heated by the molten metal.

17 Claims, 18 Drawing Sheets

Related U.S. Application Data

(60) Provisional application No. 62/329,603, filed on Apr. 29, 2016.

(58) Field of Classification Search
CPC .. F16C 43/02; F16C 2226/60; F16C 2240/46; C01B 21/0602; C01B 33/26
See application file for complete search history.

(56) References Cited

U.S. PATENT DOCUMENTS

| | | | | |
|---|---|---|---|---|
| 831,727 | A | 9/1906 | Loomis | |
| 1,305,330 | A | 6/1919 | Woleven et al. | |
| 2,115,465 | A | 4/1938 | Merten | |
| 2,695,248 | A | 11/1954 | Ornitz et al. | |
| 3,577,619 | A | 5/1971 | Strandel | |
| 3,595,207 | A | 7/1971 | Stricker | |
| 3,664,293 | A | 5/1972 | Hozumi et al. | |
| 3,734,579 | A | 5/1973 | Schumacher | |
| 3,861,012 | A | 1/1975 | Spaeder | |
| 3,927,449 | A | 12/1975 | Gibble et al. | |
| 4,416,137 | A | 11/1983 | Marshall | |
| 5,072,689 | A * | 12/1991 | Nakagawa | C23C 2/003 118/419 |
| 5,411,462 | A | 5/1995 | Link | |
| 5,538,558 | A | 7/1996 | Ookouchi et al. | |
| 5,538,559 | A * | 7/1996 | Kleimeyer | F16C 33/04 118/423 |
| 5,571,328 | A * | 11/1996 | Newland | C23C 2/003 118/419 |
| 5,667,310 | A | 9/1997 | Oyagi et al. | |
| 5,711,613 | A | 1/1998 | Ookouchi et al. | |
| 5,718,766 | A | 2/1998 | Vignot et al. | |
| 6,554,904 | B1 | 4/2003 | Gimpel et al. | |
| 8,210,999 | B2 | 7/2012 | Hamayoshi et al. | |
| 8,915,830 | B2 | 12/2014 | March et al. | |
| 2003/0133632 | A1 | 7/2003 | Hall | |
| 2010/0064968 | A1* | 3/2010 | Challaye | F16C 13/02 118/428 |
| 2015/0068454 | A1* | 3/2015 | Blumenau | F16C 13/024 118/500 |
| 2018/0002796 | A1 | 1/2018 | Niedringhaus et al. | |
| 2019/0194790 | A1 | 6/2019 | Cadotte et al. | |

FOREIGN PATENT DOCUMENTS

| | | | |
|---|---|---|---|
| EP | 0346855 | A2 | 12/1989 |
| EP | 0524851 | | 1/1993 |
| EP | 0292953 | | 11/1998 |
| FR | 2921135 | | 3/2009 |
| JP | S55-150549 | | 1/1980 |
| JP | S55-150549 | | 11/1980 |
| JP | H02-030310 | | 1/1990 |
| JP | H05-070915 | | 3/1993 |
| JP | H05-070915 | A | 3/1993 |
| JP | H05-287475 | | 11/1993 |
| JP | 2000-233986 | | 8/2000 |
| JP | 2001-234924 | A | 8/2001 |
| JP | 2003-306753 | | 10/2003 |
| WO | WO 2010/111341 | A1 | 9/2010 |
| WO | WO 2012/136713 | | 10/2012 |
| WO | WO 2016/103044 | A1 | 6/2016 |

OTHER PUBLICATIONS

International Search Report and Written Opinion dated Aug. 25, 2017 for Application No. PCT/US17/30398, 20 pgs.

Taiwanese Office Action dated Aug. 29, 2018 for Application No. 106114406, 14 pgs.

Saint-Gobain Ceramics, "Advancer Silicon Nitride Bonded Silicon Carbide," Technical Bulletin, Jan. 2005, 1 page.

Rosenflanz, A., "Silicon Nitride and Sialon Ceramics," Current Opinion in Solid State and Materials Science vol. 4, 1999, pp. 453-459.

International Search Report and Written Opinion dated Mar. 21, 2019 for Application No. PCT/US2018/066702, 11 pgs.

Thiruvenga, A. et al., "Mechanical Properties of Metals and their Cavitation Damage Resistance," Hydronautics Incorporated, Office of Naval Research Department of the Navy, Contract No. Nonr 3755(00) (FBM) 062-203, Jun. 1964, pp. 1-47.

U.S. Appl. No. 15/583,450.

U.S. Appl. No. 16/226,895.

U.S. Appl. No. 16/546,539.

* cited by examiner

METHOD AND APPARATUS FOR EXTENDING THE CAMPAIGN LIFE OF STABILIZERS FOR A COATING LINE

The present application is a continuation-in-part of U.S. patent application Ser. No. 15/583,450, entitled "Method for Extending the Campaign Life of Stabilizers for a Coating Line," filed May 1, 2017, which claims priority from provisional patent application Ser. No. 62/329,603, entitled "Method for Extending the Campaign Life of Stabilizers for an Aluminizing Line," filed on Apr. 29, 2016, the disclosures of which are each incorporated herein by reference.

BACKGROUND

Coating is a common process used in steel making to provide a thin metal coating (e.g., aluminum, zinc, and/or alloys thereof) on the surface of a steel substrate, such as an elongated steel sheet or strip. It should be understood that an elongated steel sheet or strip are used and understood herein to be interchangeable. The coating process may be generally incorporated into a continuous coating line where an elongated steel sheet is threaded through a series of roll assemblies to subject the steel sheet to various treatment processes. During the coating portion of this process, the steel sheet is manipulated through a bath of molten metal to coat the surfaces of the steel sheet.

To aid in manipulation of the steel sheet, various components may be disposed within the molten metal bath. Some of these components may be subject to wear due to continuous movement of the components and/or the harsh environment due to the presence of molten metal. When wear reaches an unacceptable level, the continuous coating line is shut down and the components therein are reworked. This procedure generally results in increased costs and undesirable manufacturing delays. However, these costs and delays may be reduced by increasing the service life of various components submerged within the metal bath.

Accordingly, it may be desirable to include various features within a coating line to improve the overall service life of components subject to wear. To overcome these challenges roller sleeves made of ceramic or refractory material are mechanically locked to a roller journal, thereby providing protection from wear. Alternatively, roller inserts made of ceramic or refractory materials are applied to an exterior surface of a roller journal to protect against wear.

SUMMARY

Steel journals for rolls rotating within molten metal baths encounter at least some abrasion and chemical attack when used within molten metal baths for aluminizing processes. Under some circumstances, this abrasion and/or chemical attack may lead to reduced duty cycles for such rollers. Thus, it is desirable to reduce abrasion and/or chemical attack encountered with steel journals used in coating processes.

Ceramic or refractory materials provide superior resistance to abrasion and chemical attack encountered in environments surrounded by molten metal. However, challenges have been encountered with integrating ceramic or refractory materials into roller assemblies submerged in molten metal. Thus, the present application relates to structures and/or methods for incorporating ceramic or refractory materials into roller assemblies between a journal and a bearing block.

BRIEF DESCRIPTION OF THE FIGURES

The accompanying figures, which are incorporated in and constitute a part of this specification, illustrate embodiments, and together with the general description given above, and the detailed description of the embodiments given below, serve to explain the principles of the present disclosure.

DETAILED DESCRIPTION

The present application generally relates to structures and/or methods for incorporating ceramic or refractory materials within a roll assembly submerged within molten metal. In some instances, this involves incorporating ceramic or refractory material between a journal and a bearing block. In such a configuration, it has been found that the presence of the ceramic or refractory material reduces wear on the journal that may result through rotation of the journal relative to the bearing block. In addition, the presence of the ceramic or refractory material may also reduce the propensity of the journal to be subject to chemical attack from the molten metal.

Figure 1:
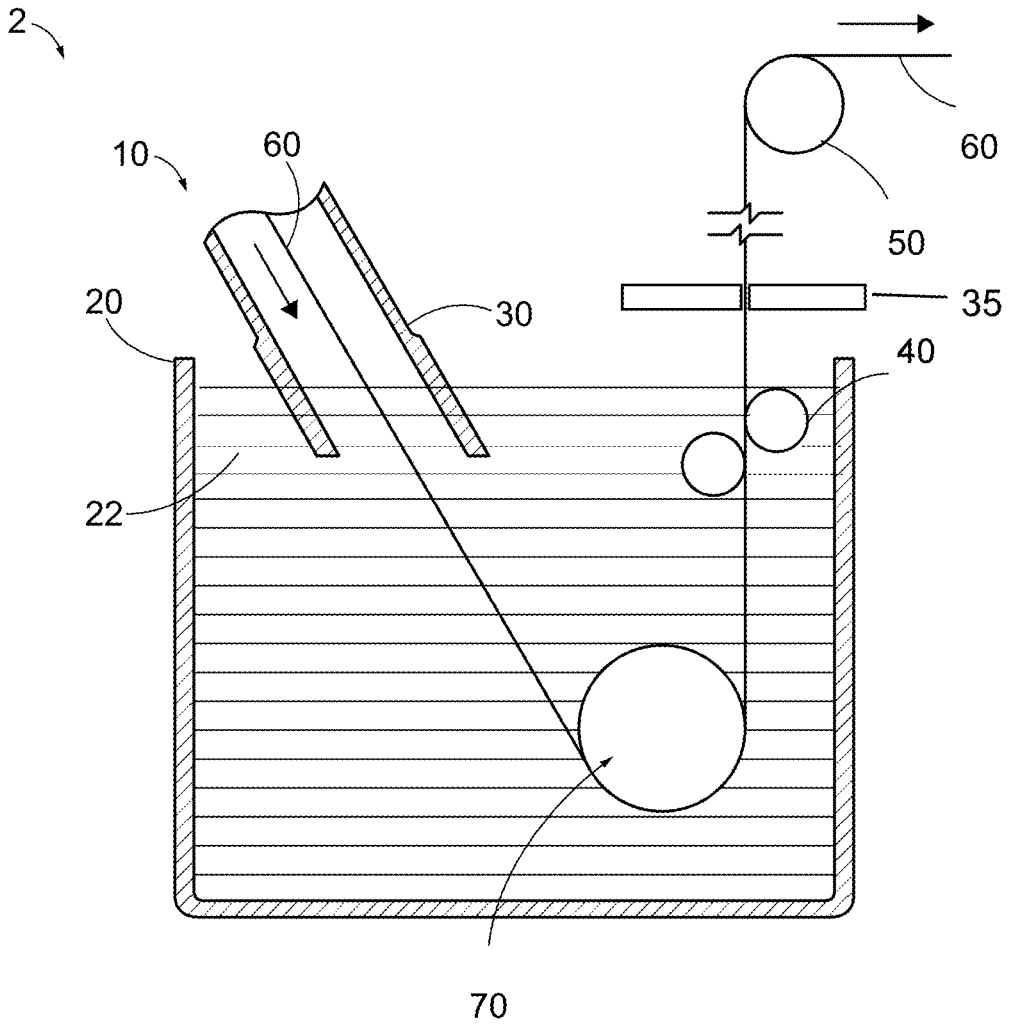
FIG. 1 depicts a schematic view of a coating portion of a continuous steel processing line.

FIG. 1 shows a schematic cross-sectional representation of a coating portion (10) of a steel processing line (2), such as a continuous steel processing line. Although not shown, it should be understood that prior to entry, steel sheet (60) may be subjected to a variety of other steel processing operations in other portions of steel processing line (2). For instance, steel sheet (60) may be subjected to hot or cold reduction rolling, various heat treatments, pickling, and/or etc. Alternatively, other steel processing operations may be eliminated such that coating portion (10) is configured as a standalone coating line in some examples.

In the illustrated embodiment, coating portion (10) includes a hot dip tank (20), a snout (30), one or more roll assemblies (40, 50, 70). As will be understood, coating portion (10) is generally configured to receive an elongate steel sheet (60) for coating steel sheet (60). Hot dip tank (20) is defined by a solid wall configured to receive molten metal (22), such as aluminum, zinc, and/or alloys thereof. Snout (30) is configured to be partially submerged within molten metal (22). Accordingly, snout (30) generally provides an air tight seal around steel sheet (60) during entry into molten metal (22). In some instances, snout (30) is filled with a protective or reducing gas such as hydrogen and/or nitrogen to limit chemical oxidation reactions that may occur during entry of steel sheet (60) into molten metal (22).

One or more roll assemblies (40, 50, 70) are positioned relative to hot dip tank (20) to support steel sheet (60) through coating portion (10). For instance, a pot or sink roll assembly (70) may be submerged within molten metal (22) such that pot roll assembly (70) is generally configured to rotate and thereby redirect steel sheet (60) out of hot dip tank (20). One or more stabilizer and correcting roll assemblies (40) may then be positioned relative to hot dip tank (20) to stabilize steel sheet (60) as steel sheet (60) exits molten metal (22). For instance, stabilizer and correcting roll assemblies (40) may be used to position steel sheet (60) as steel sheet (60) enters air knives (35). Stabilizer and correcting roll assemblies (40) may also be used to improve the shape of steel sheet (60). A deflector roll assembly (50) may then be generally configured to redirect steel sheet (60) to other portions of steel processing line (2) after steel sheet (60) has been coated. While coating portion (10) of the present example is shown with only one of each of a pot roll assembly (70), a stabilizer and correcting roll assembly (40), and a deflector roll assembly (50), in some other versions any suitable number of roll assemblies (40, 50, 70) may be used.

Figure 1A:
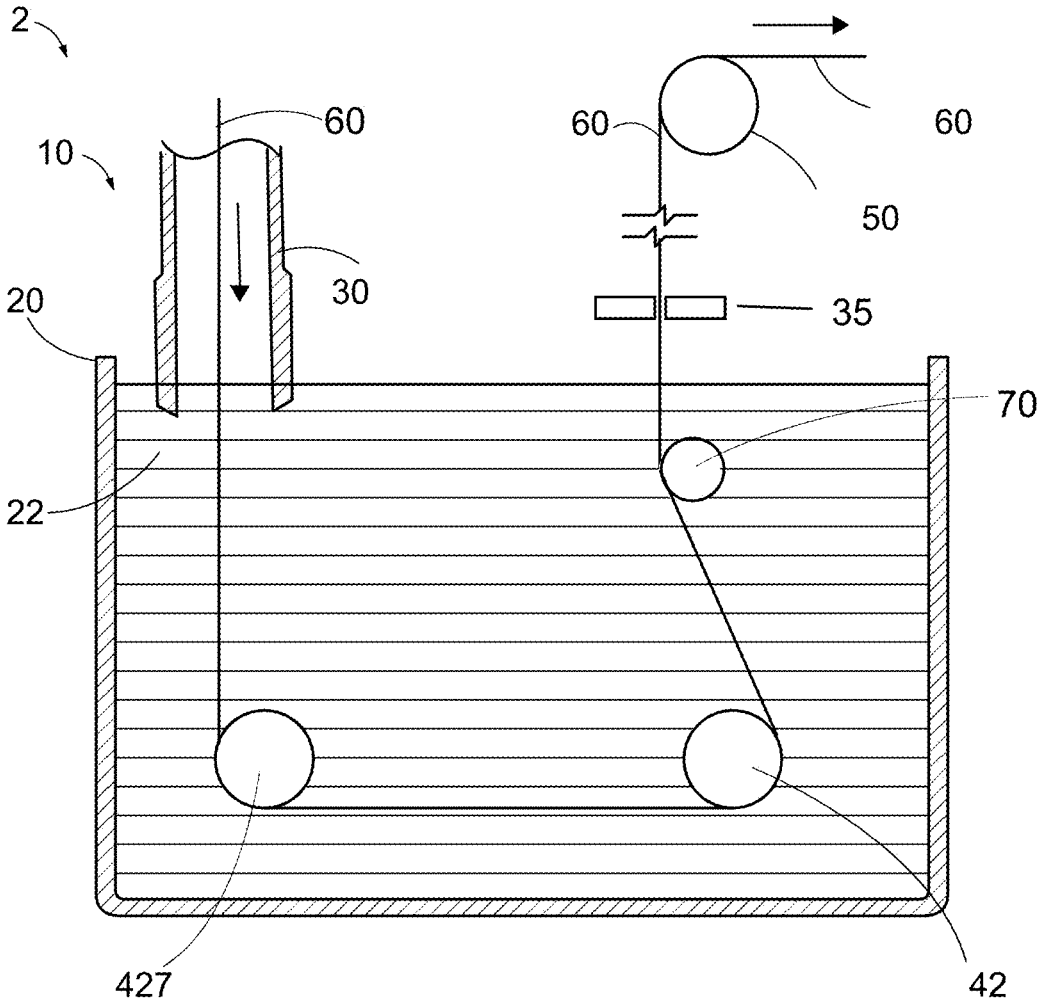
FIG. 1A depicts a schematic view of an alternative configuration for the coating portion of FIG. 1.

FIG. 1A shows an alternative configuration of coating portion (10) with stabilizer and correcting roll assembly (40) omitted. In lieu of, or in alternative to, stabilizer and correcting roll assembly (40), the alternative configuration shown in FIG. 1A includes two sink roll assemblies (42) disposed entirely within hot dip tank (20). Sink roll assemblies (42) generally operate similarly to other roll assemblies described herein. For instance, sink roll assemblies (42) are generally configured to manipulate steel sheet (60) through various portions of the coating process. In the present example, sink roll assemblies (42) manipulate steel sheet (60) within molten metal (22) to promote complete coating of steel sheet (60). Sink roll assemblies (42) additionally provide for an increased amount of travel path through molten metal (22). This feature generally increases the time in which steel sheet (60) is disposed within molten metal (22). Once steel sheet (60) passes through sink roll assemblies (42), steel sheet (60) may then be redirected in a desired direction by pot roll assembly (70) and deflector roll assembly (50). It should be understood that although FIGS. 1 and 1A both illustrate discrete configurations for coating portion (10), in other examples coating portion (10) includes other alternative configurations that combine various elements from the configurations shown in FIGS. 1 and 1A.

A roll assembly incorporating a roller sleeve comprising refractory ceramic materials is discussed in more detail below. Because such a roller sleeve may reduce wear, corrosion, and/or abrasion of the roll assembly, it should be understood that such a roller sleeve may be incorporated into any one or more roll assemblies in a continuous coating line. These roll assemblies may include, but are not limited to, any stabilizing and correcting roll assemblies (40), sink roll assemblies (42), deflector roll assemblies (50), and/or pot roll assemblies (70) as described above.

Figure 2:
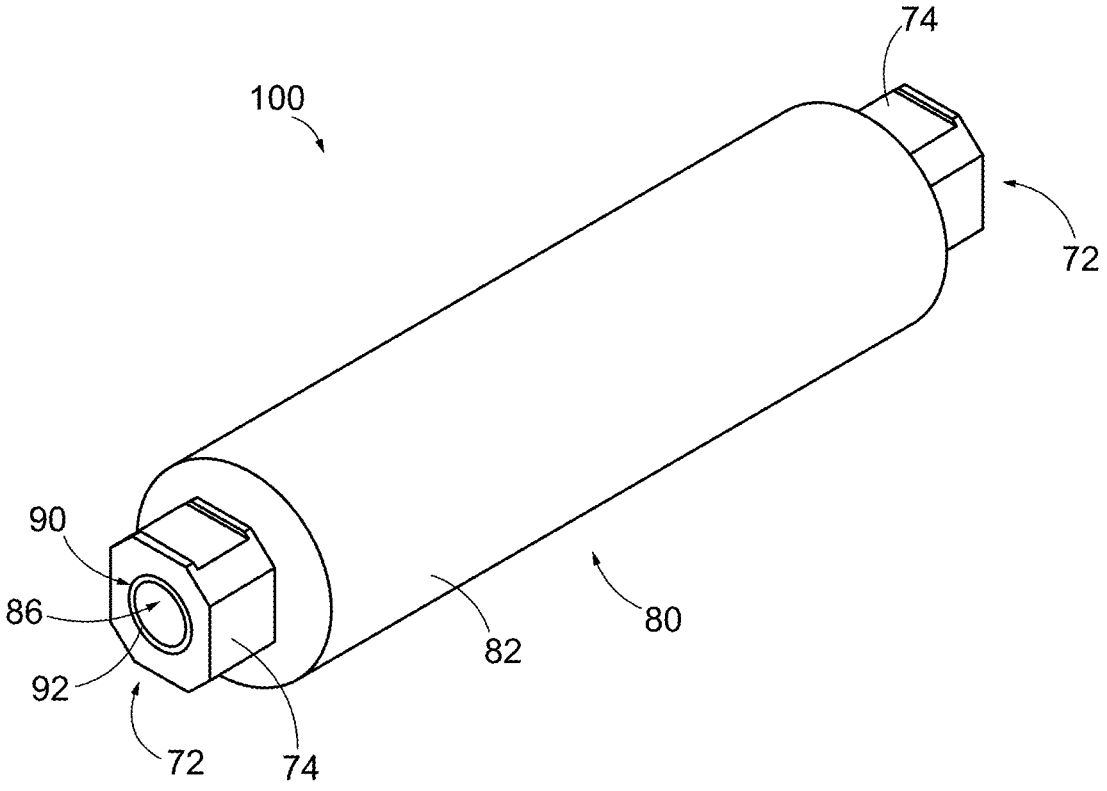
FIG. 2 depicts a perspective view of a roll assembly that may be readily incorporated into the coating portion of FIG. 1.

Referring to FIG. 2, roll assembly (100) comprises two bearing blocks (72), a roll (80), and a roller sleeve (90) disposed between each bearing block (72) and roll (80). Each bearing block (72) is generally configured to receive at least a portion of roll (80) to promote rotation of roll (80) relative to bearing block (72). Although not shown, it should be understood that each bearing block (72) is generally coupled to a fixture or other structure to hold each bearing block (72) in position within hot dip tank (20).

Figure 3:
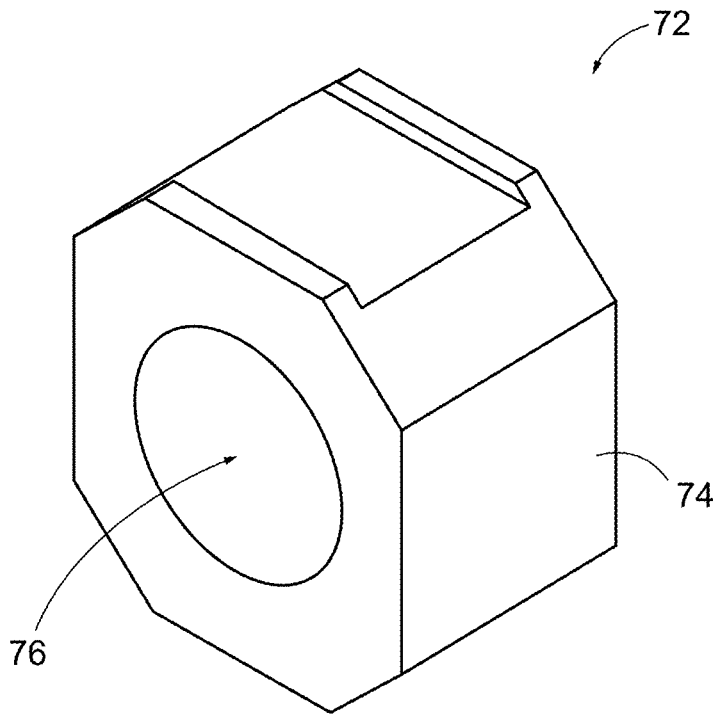
FIG. 3 depicts a perspective view of a bearing block of the roll assembly of FIG. 2.

An illustrative bearing block (72) is best seen in FIG. 3. As can be seen, bearing block (72) includes a generally octagonal body (74). The octagonal shape of body (74) is generally configured to provide surfaces by which a fixture or other structure can attach to bearing block (72) to position bearing block (72) within hot dip tank (20). Although body (72) of the present example is shown with octagonal structure, it should be understood that in other examples other suitable structures may be used such as square, hexagonal, triangular, circular, etc.

Regardless of the particular shape used for body (74), body (74) defines a receiving bore (76) through the center of bearing block (72). Receiving bore (76) is generally defined by a cylindrical shape. As will be described in greater detail below, receiving bore (76) is configured to receive roller sleeve (90) and at least a portion of roll (80) to permit roller sleeve (90) to freely rotate within bore (76).

Bearing block (72) comprises a ceramic material that has high strength and is resistant to wear at high temperature. This ceramic material may additionally have a low coefficient of thermal expansion, resistance to thermal shock, resistance to wetting by molten metal, resistance to corrosion, and is substantially chemically inert to molten non-ferrous metals. By way of example only, suitable ceramic materials may include a class of ceramics known as SiAlON ceramics. SiAlON ceramics are high-temperature refractory materials that may be used in handling molten aluminum. SiAlON ceramics generally exhibit good thermal shock resistance, high strength at high temperatures, exceptional resistance to wetting by molten aluminum, and high corrosion resistance in the presence of molten non-ferrous metals. Bearing block (72) of the present example comprises CRYSTON CN178 manufactured by Saint-Gobain High-Performance Refractories, although numerous SiAlON class ceramics may be used.

Figure 4:
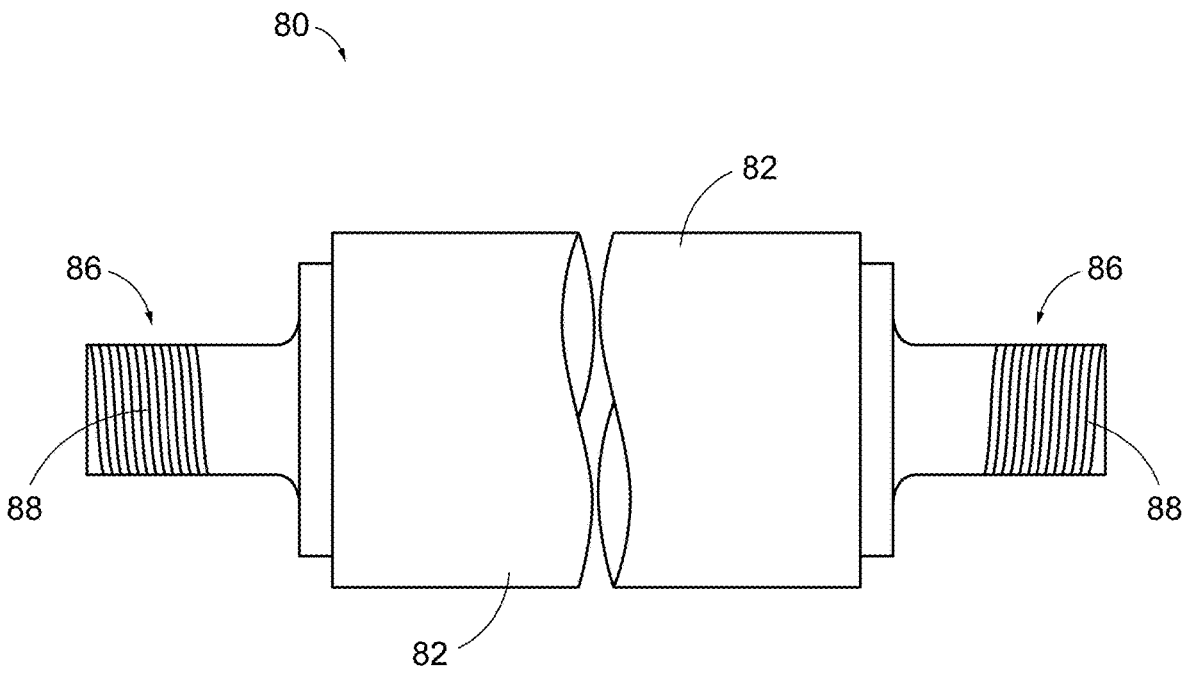
FIG. 4 depicts a front elevational view of a roll of the roll assembly of FIG. 2.

Roll (80) is shown in FIG. 4. As can be seen, roll (80) includes a roll portion (82) and a journal (86) extending from each side of roll portion (82). Generally, roll portion (82) and journal (86) comprise steel or another metallic alloy. Roll portion (82) comprises a generally elongate cylindrical shape. The cylindrical shape of roll portion (82) is generally configured to receive steel sheet (60) to permit at least a portion of steel sheet (60) to wrap around at least a portion of roll portion (82). Thus, it should be understood that a width of roll portion (82) generally corresponds to the width of steel sheet (60) such that the width of roll portion (82) is wider than steel sheet (60). This may compensate for strip tracking through coating portion (10).

As described above, each journal (86) extends outwardly from roll portion (82). Each journal (86) comprises a generally cylindrical shape with an outer diameter that is less than the outer diameter defined by roll portion (82). Each journal (86) is sized to be received by bore (76) of a respective bearing block (72). However, as will be described in greater detail below, each journal (86) is generally undersized relative to bore (76) of bearing block (72) to permit space for roller sleeve (90) disposed between bearing bock (72) and journal (86).

In one embodiment, each journal (86) further includes threading (88) disposed on the outer surface of each journal (86). As will be described in greater detail below, threading (88) is generally configured to engage corresponding features of each respective roller sleeve (90) to couple each roller sleeve (90) to each journal (86). In the present example, threading (88) on each journal (86) is oriented to account for rotation of stab roll (80). For instance, if one journal (86) includes right hand threading, the opposite journal (86) includes left hand threading. This configuration of threading (88) prevents each roller sleeve (90) from becoming loose or otherwise unscrewing as stab roll (80) is rotated by friction between steel sheet (60) and roll portion (82). In some examples, threading (88) may include rounded peaks to accommodate variation in the internal geometry of roller sleeve (90) as will be described in greater detail below.

Figure 5:
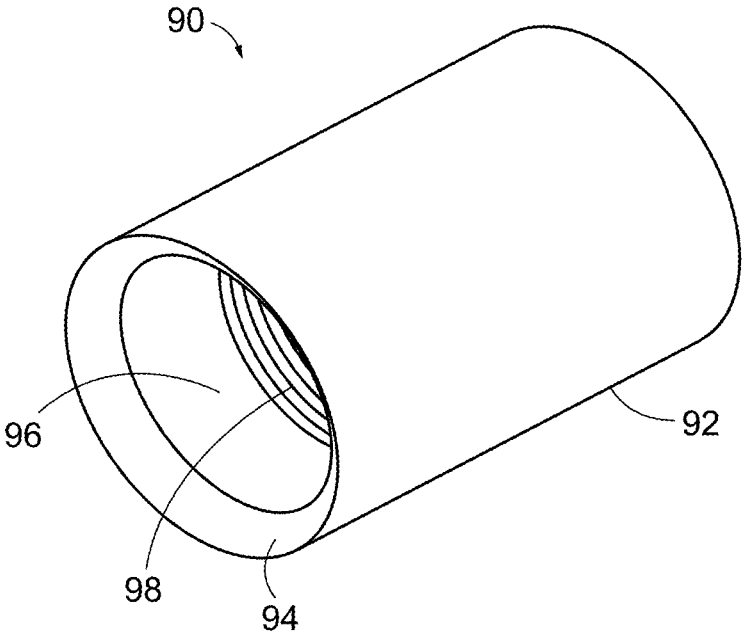
FIG. 5 depicts perspective view of a roller sleeve of the roll assembly of FIG. 2.
Figure 6:
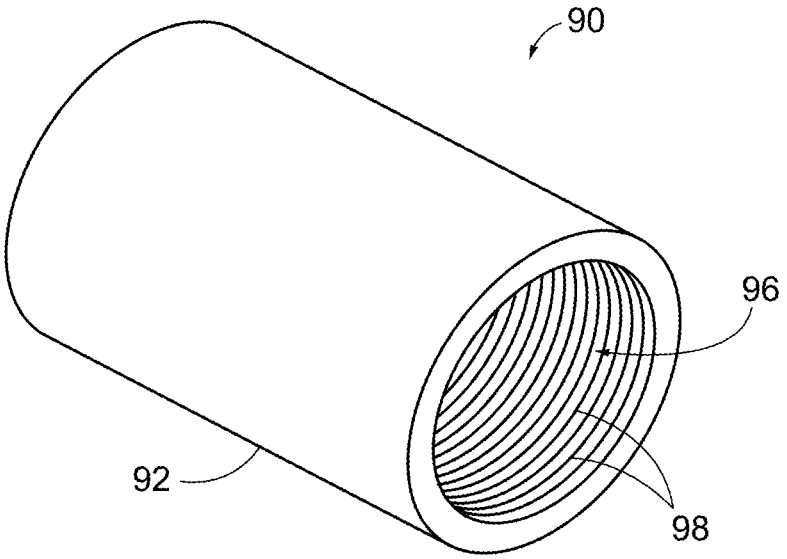
FIG. 6 depicts another perspective view of the roller sleeve of FIG. 5.

An illustrative roller sleeve (90) is shown in FIGS. 5 and 6. Roller sleeve (90) is generally configured to provide a durable non-reactive barrier between a respective journal (86) and a respective bearing block (72). As will be understood, roller sleeve (90) generally rotates with journal (86) such that roller sleeve (90) rotates within bearing block (72) relative to bearing block (72). Accordingly, a portion of an exterior surface of each roller sleeve (90) is in direct contact with a portion of an interior surface of bore (76) of bearing block (72). Roller sleeve (90) may thereby form a plan bearing with each journal (86) without the use of rollers or rolling bodies. Each journal (86) and roller sleeve (90) may thereby rotate together within a stationary bearing block (72).

As can be seen, roller sleeve (90) comprises a generally cylindrical body (92). In the illustrated embodiment, at least one side of body (92) includes a chamfered or beveled edge (94). Edge (94) is generally configured to abut an interface between a respective journal (86) and roll portion (82). Although edge (94) is shown has having a generally chamfered or beveled shape, it should be understood that any other suitable shape may be used such as a fillet shape, a squared shape, a j-groove, or etc.

Body (92) defines a cylindrical bore (96) extending through roller sleeve (90). The interior of bore (96) includes threading (98) extending at least partially though the length of bore (96). Threading (98) is generally configured to engage threading (88) on the outer diameter of a respective journal (86). Thus, it should be understood that threading within bore (96) is configured to mechanically fasten roller sleeve (90) to a respective journal (86).

Figure 7:
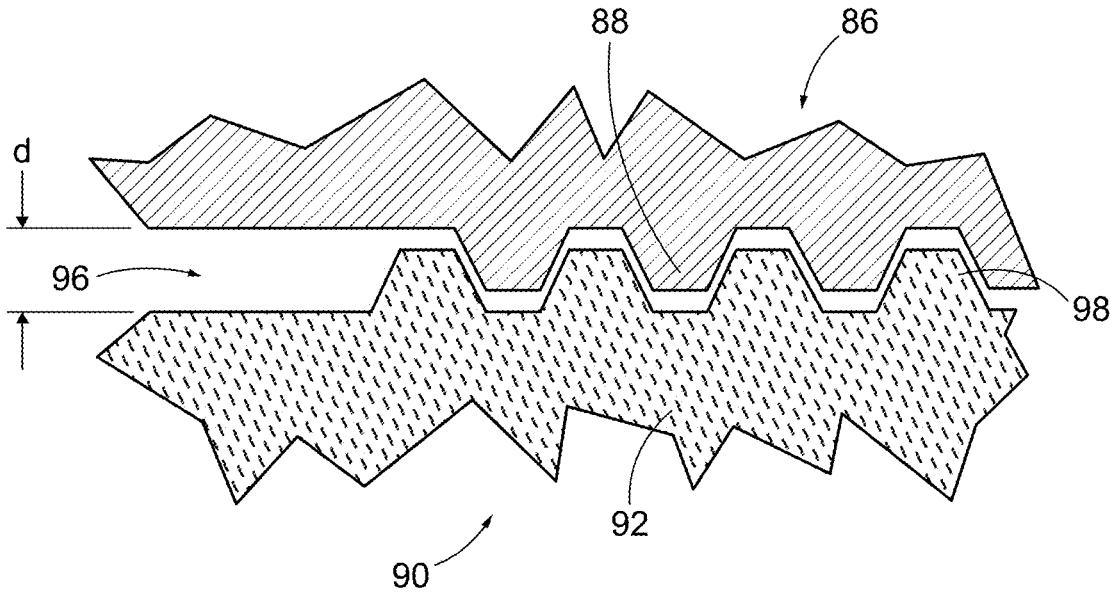
FIG. 7 depicts a partial front cross-sectional view of a coupling between the roll of FIG. 4 and the roller sleeve of FIG. 5.

The inner diameter of bore (96) generally corresponds to the outer diameter of each journal (86). However, as best seen in FIG. 7, the present example includes a predetermined clearance (d) between the inner diameter of bore (96) and the outer diameter of journal (86). Initially, it was theorized that this clearance (d) could be derived from the difference between the thermal expansion ratio of journal (86) and the thermal expansion ratio of roller sleeve (90) such that once both journal (86) and roller sleeve (90) approach the temperature of dip tank (20), this clearance (d) would be substantially eliminated. However, in the present example, the clearance (d) between bore (96) and journal (86) is unexpectedly not exclusively tied to the thermal expansion ratios of journal (86) and roller sleeve (90). In particular, it has been found that some clearance (d) between journal (86) and roller sleeve (90) at temperature of hot dip tank (20) is beneficial to improving the durability of roller sleeve (90) during the aluminizing procedure. Thus, it should be understood that in the present example at least some clearance (d) is maintained between the inner diameter of bore (96) and the outer diameter of journal (86) throughout the aluminizing procedure. In some examples, a suitable clearance (d) may be approximately 0.220 in. In other examples, clearance (d) may be between about 0.220 and 0.200 in. In some examples, the width of threading (88) may also provide some width clearance. In these examples, this width clearance may vary between approximately 0.005 in. and approximately 0.030 in.

Although the clearance (d) between the inner diameter of bore (96) and the outer diameter of journal (86) referred to above is described as being beneficial for improving the durability of roller sleeve (90), it should be understood that this clearance (d) is also limited in the present example. For instance, if the clearance (d) between the inner diameter of bore (96) and the outer diameter of journal (86) is too significant, some wetting of the molten aluminum (22) may occur, thereby transporting molten aluminum (22) into the clearance (d) between the inner diameter of bore (96) and the outer diameter of journal (86). Although this may depend at least in part on the material of roller sleeve (90), it should be understood that in the present example the clearance (d) between the inner diameter of bore (96) and the outer diameter of journal (86) is limited so as to minimize or prevent transport of molten aluminum (22) into the clearance (d).

Roller sleeve (90) comprises a ceramic material that has high strength and is resistant to wear at high temperature. This ceramic material additionally may have a low coefficient of thermal expansion, resistance to thermal shock, resistance to wetting by molten metal, resistance to corrosion, and is substantially chemically inert to molten metals. By way of example only, suitable ceramic materials may include a class of ceramics known as SiAlON ceramics. As described above, SiAlON ceramics are high-temperature refractory materials that may be used in handling molten aluminum. SiAlON ceramics generally exhibit good thermal shock resistance, high strength at high temperatures, exceptional resistance to wetting by molten aluminum, and high corrosion resistance in the presence of molten non-ferrous metals. Roller sleeve (90) of the present example comprises ADVANCER® nitride bonded silicon carbide manufactured by Saint-Gobain Ceramics, although numerous SiAlON-class ceramics may be used.

In an exemplary use, steel sheet (60) is wrapped about roll assembly (100). Friction between steel sheet (60) and roll portion (82) of roll (80) causes roll (80) to rotate as steel sheet (60) moves relative to roll assembly (100). Rotation of roll (80) causes corresponding rotation of each journal (86), which also causes rotation of each roller sleeve (90) via engagement between threading (88, 98). Due to the opposite threading (88) on each journal (86), each roller sleeve (90) stays secured to each respective journal (86) due to the rotation of each journal (86). It should be understood that in some examples only a portion of threading (88) of journal (86) may contact threading (98) of roller sleeve (90) at a given time. For instance, during operation, steel sheet (60) may pull roll (80) in a particular direction. This will cause journal (86) to move laterally within roller sleeve (90) due to clearance such that journal (86) and roller sleeve (90) are not precisely coaxially aligned. When this occurs, depending on the size of clearance (d), one side of threading (88) of journal (86) may disengage from threading (98) of roller sleeve (90). Although some disengagement may occur, the coupling function of threading (88, 98) may still be retained due to full engagement of threading (88, 98) on the opposite side of journal (86) and roller sleeve (90). Thus, each journal (86) and each roller sleeve (90) rotate together within a respective bearing block (72), while each bearing block (72) secures the axial position of roll (80). Still other suitable configurations for roller sleeve (90) and/or roll assembly (100) will be apparent to one with ordinary skill in the art in view of the teachings herein.

Figure 8:
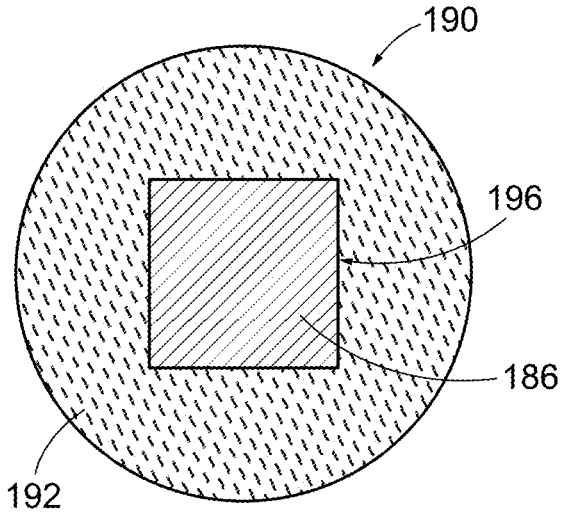
FIG. 8 depicts a side cross-sectional view of an alternative journal and roller sleeve that may be readily incorporated into the stab roll of FIG. 4.
Figure 9:
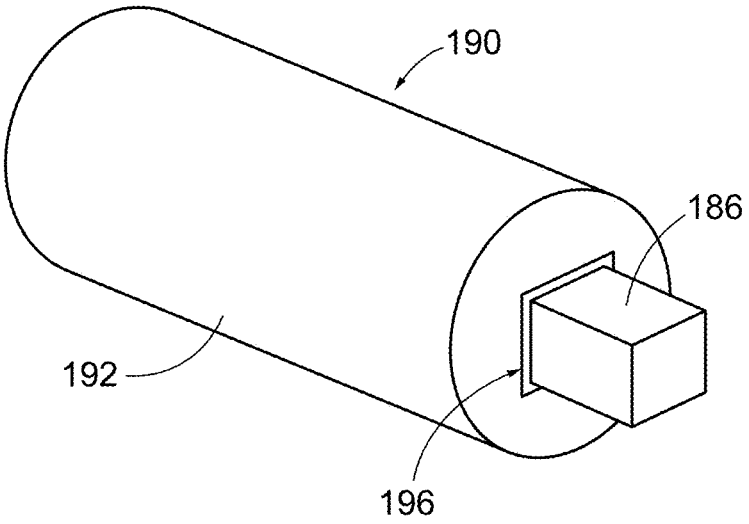
FIG. 9 depicts a perspective view of the journal and roller sleeve of FIG. 8.

For instance, FIGS. 8 and 9 show an exemplary alternative journal (186) and roller sleeve (190) that may be readily incorporated into roll assembly (100) described above. It should be understood that unless otherwise noted herein, journal (186) and roller sleeve (190) are respectively substantially similar to journals (86) and roller sleeves (90) described above. Journal (186) of the present example comprises a generally square lateral cross-section. As will be described in greater detail below, this generally square shape permits journal (186) to engage roller sleeve (190) and thereby induce rotation of roller sleeve (190) relative to a respective bearing block (72). As will be understood, this configuration permits structures similar to threading (88) of journal (86) to be omitted from journal (186).

Roller sleeve (190) comprises a cylindrical body (192) that is generally configured to fit over journal (186). Body (192) defines a bore (196) extending entirely through roller sleeve (190). Bore (196) of the present example defines a square-shaped lateral cross-section that generally corresponds to the shape of journal (186) described above.

Bore (196) of the present example is generally sized to receive journal (186). Although bore (196) of the present example is generally sized to receive journal (186) it should be understood that in the present example, bore (196) is also sized to provide at least some clearance relative to the exterior of journal (186) as similarity described above with respect to roller sleeve (90) and journal (86). As with clearance (d) described above, the clearance associated with roller sleeve (90) and journal (86) is generally configured to be maintained throughout the coating procedure despite expansion of roller sleeve (190) and/or journal (86) due to the heat encountered within hot dip tank (20). As also described above, the clearance associated with roller sleeve (190) and journal (186) is also sized to minimize or prevent transport of molten metal (22) into the cavity defined by the clearance.

As described above, the corresponding square shapes defined by journal (186) and bore (196) of roller sleeve (190) are generally configured to permit journal (186) to communicate rotary motion to roller sleeve (190). Although corresponding square shapes are shown herein, it should be understood that numerous alternative cross-sectional shapes may be used. For instance, in some examples journal (186) and bore (196) of roller sleeve (190) define a corresponding triangular, ovular, or rectangular shape. In other examples, both journal (186) and bore (196) of roller sleeve (190) define a generally cylindrical shape, but may also be keyed to still permit communication of rotation from journal (186) to roller sleeve (190). Of course, numerous alternative geometries for journal (186) and bore (196) of roller sleeve (190) will be apparent to those of ordinary skill in the art in view of the teachings herein. In each case, there is a mechanical locking feature, be it threading or other mechanical lock configuration that restricts motion of the roller sleeve relative to the journal, so as to allow both parts to rotate together with the bore.

Figure 10:
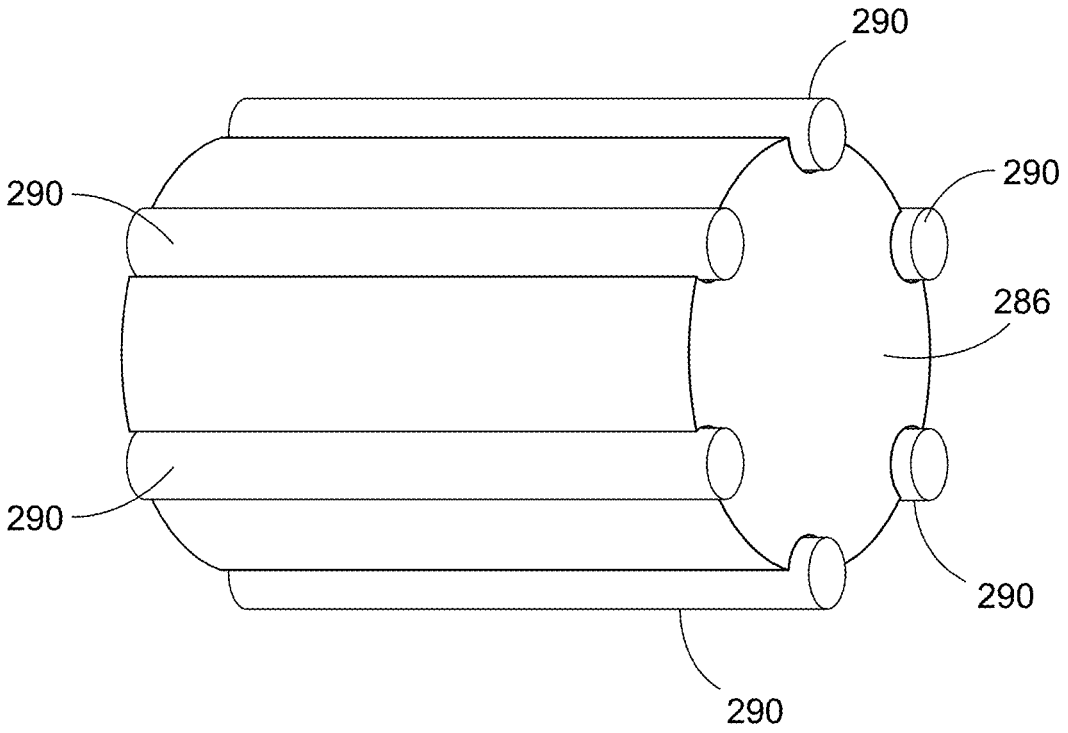
FIG. 10 depicts a perspective view of another alternative journal that may be readily incorporated into the roll of FIG. 4.

FIG. 10 shows an alternative journal (286) that may be readily incorporated into roll assembly (100) described above. Unlike journal (86) described above, journal (286) of the present example is not configured for use with a structure similar to roller sleeve (90). Instead, journal (86) integrates a series of cylindrical ceramic inserts (290) oriented longitudinally around the outer surface of journal (286). To receive inserts (290), journal (286) is machined to include a plurality of channels (not shown) that are configured to receive inserts (290). However, the channels in the outer surface of journal (286) are sized to accommodate only a portion of each insert (290) such that a portion of each inert (290) protrudes from the outer surface of journal (286). Thus, it should be understood that each inert (290) is configured to engage the interior of bearing block (72), thereby separating the outer surface of journal (286) from the interior of bearing block (72).

Coupling between journal (286) and inserts (290) can be by any suitable means. For instance, in the present example inserts (290) are welded or bonded onto journal (286) by ultrasonic welding, friction welding, soldering, and/or other processes suitable for welding or bonding dissimilar materials. Alternatively, in some examples inserts (290) are secured to journal (286) by a mechanical fastener. In still other examples, the channels in journal (286) and inserts (290) may include complementary coupling features to provide a slide-in or snap fit. Of course, in other examples inserts (290) may be coupled to journal (286) by any other suitable means that will be apparent to those of ordinary skill in the art in view of the teachings herein.

Figure 11:
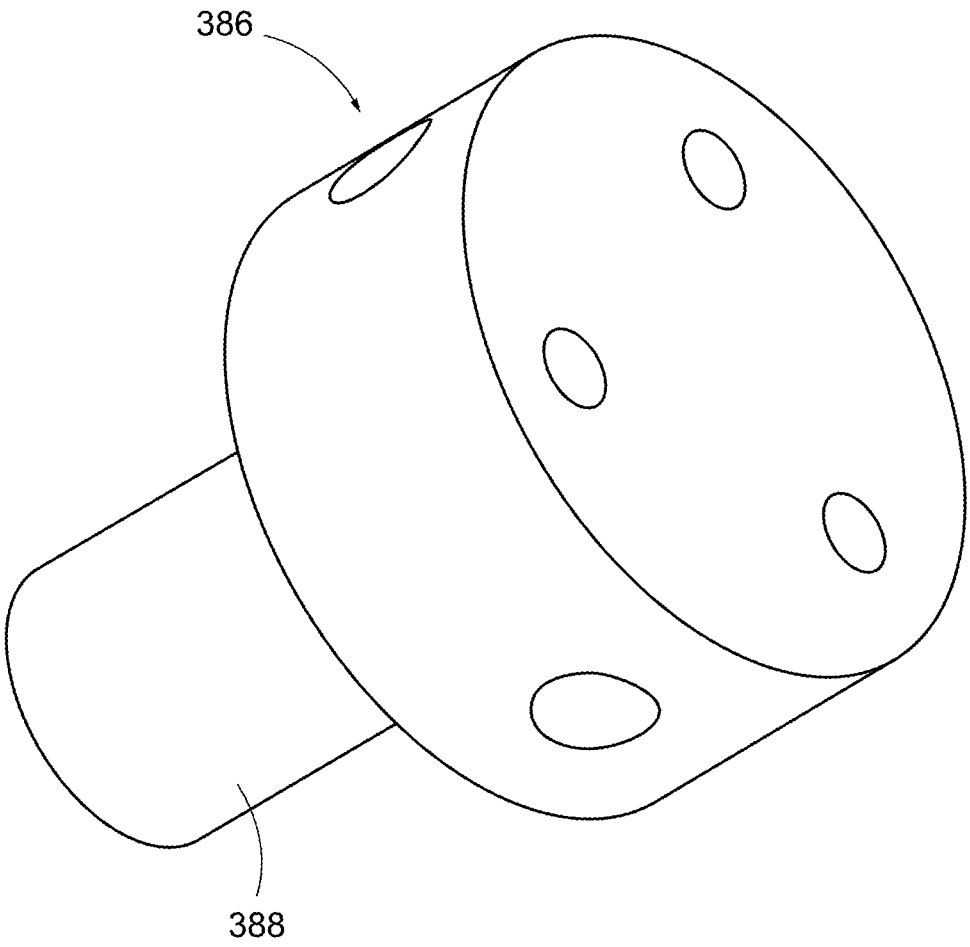
FIG. 11 depicts a perspective view of still another alternative journal that may be readily incorporated into the roll of FIG. 4.

In some instances, it may be desirable to incorporate inserts (290) into journal (286) entirely. For instance, FIG. 11 illustrates an alternative journal (386) that may be readily incorporated into roll (80) of roll assembly (100). Instead of including structures similar to inserts (290) described above as separate components, journal (386) itself comprises a ceramic material consistent with the properties described above with respect to roller sleeve (90). In the present example, journal (386) is removably couplable to roll portion (82) of roll (80) instead of being integral with roll portion (82). Thus, journal (386) of the present example includes a roller plug (388) that is configured to fit within a corresponding opening that may be bored within roll portion (82) of stab roll (80). Although not shown, it should be understood that in the present example journal (386) is mechanically locked to roll (80) by a series of pins or other mechanical fasteners.

In other examples the entire roll (80) can comprise a ceramic material, thus removing the need to separate journal (386) from roll portion (82). Of course, various alternative configurations for journal (286) may be apparent to those of ordinary skill in the art in view of the teachings herein.

Figure 12:
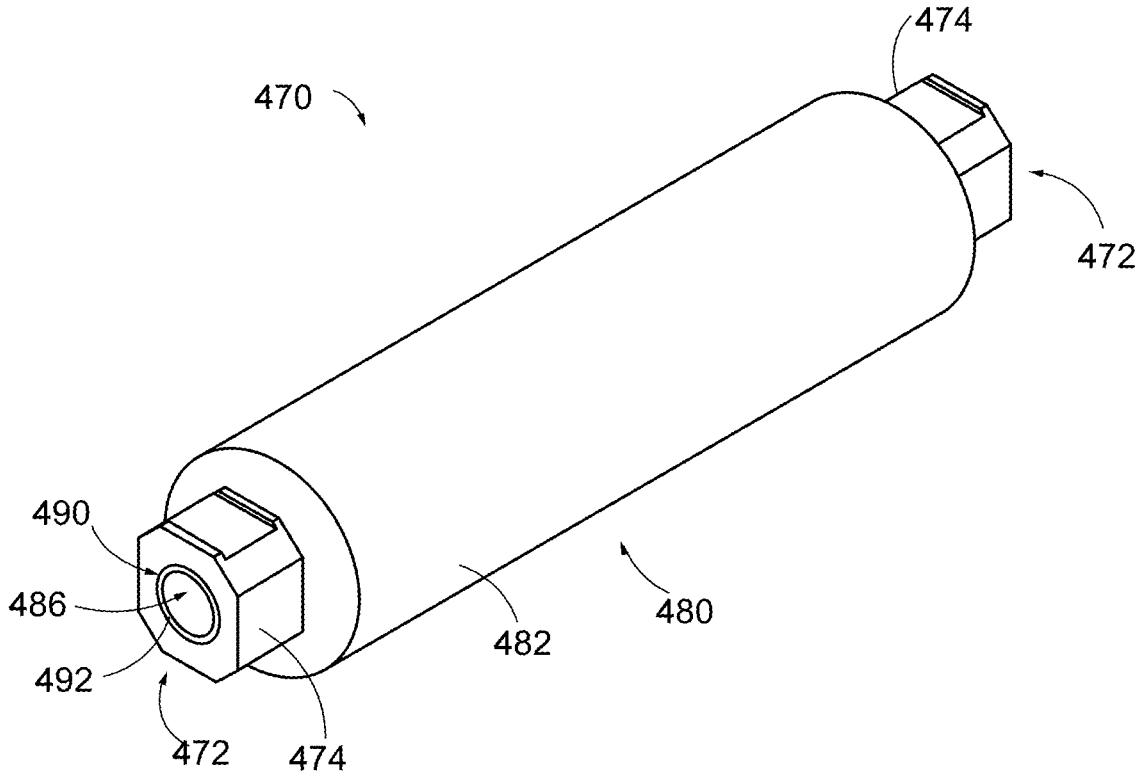
FIG. 12 depicts a perspective view of another roll assembly that may be readily incorporated into the coating portion of FIG. 1.

FIGS. 12-17 show an exemplary alternative roll assembly (470) that may be readily incorporated into the coating lines described above. It should be understood that unless otherwise noted herein, roll assembly (470) is substantially similar to roll assembly (100) described above. As can be seen in FIG. 12, roll assembly (470) includes two bearing blocks (472), a roll (480), and a roller sleeve (490) disposed between each bearing bock (472) and roll (480). Each bearing block (472) is generally configured to receive at least a portion of roll (480) to promote rotation of roll (480) relative to bearing block (472). Although not shown, it should be understood that each bearing block (472) is generally coupled to a fixture or other structure to hold each bearing bock (472) in position within hot dip tank (20).

Figure 13:
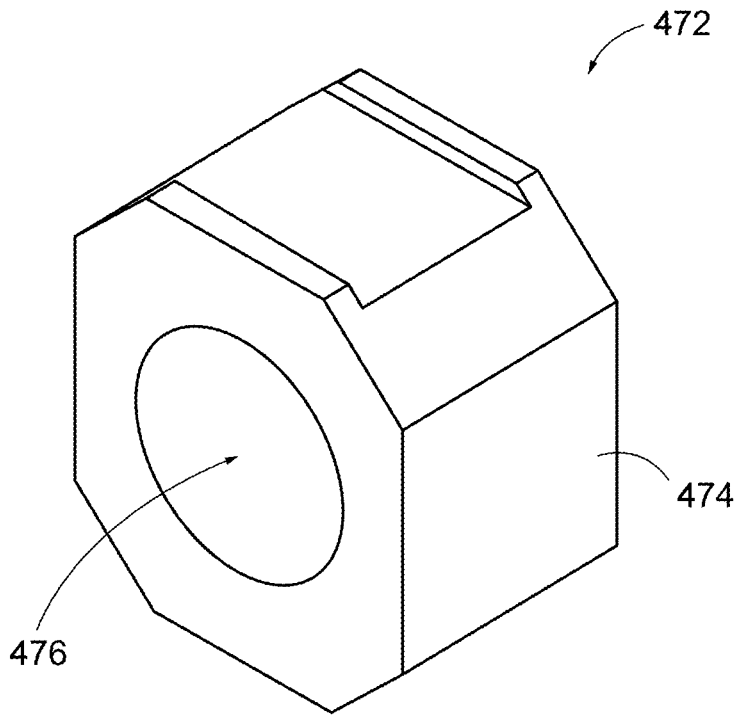
FIG. 13 depicts a perspective view of a bearing block of the roll assembly of FIG. 12.

An illustrative bearing block (472) is best seen in FIG. 13. As can be seen, bearing block (472) includes a generally octagonal body (474). The octagonal shape of body (474) is generally configured to provide surfaces by which a fixture or other structure can attach to bearing block (472) to position bearing block (472) within hot dip tank (20). Although body (472) of the present example is shown with octagonal structure, it should be understood that in other examples other suitable structures may be used such as square, hexagonal, triangular, circular, etc. Regardless of the particular shape used for body (474), body (474) defines a receiving bore (476) through the center of bearing block (472). Receiving bore (476) is generally defined by a cylindrical shape. As will be described in greater detail below, receiving bore (476) is configured to receive roller sleeve (490) and at least a portion of roll (480) to permit roller sleeve (490) to freely rotate within bore (476).

Figure 14:
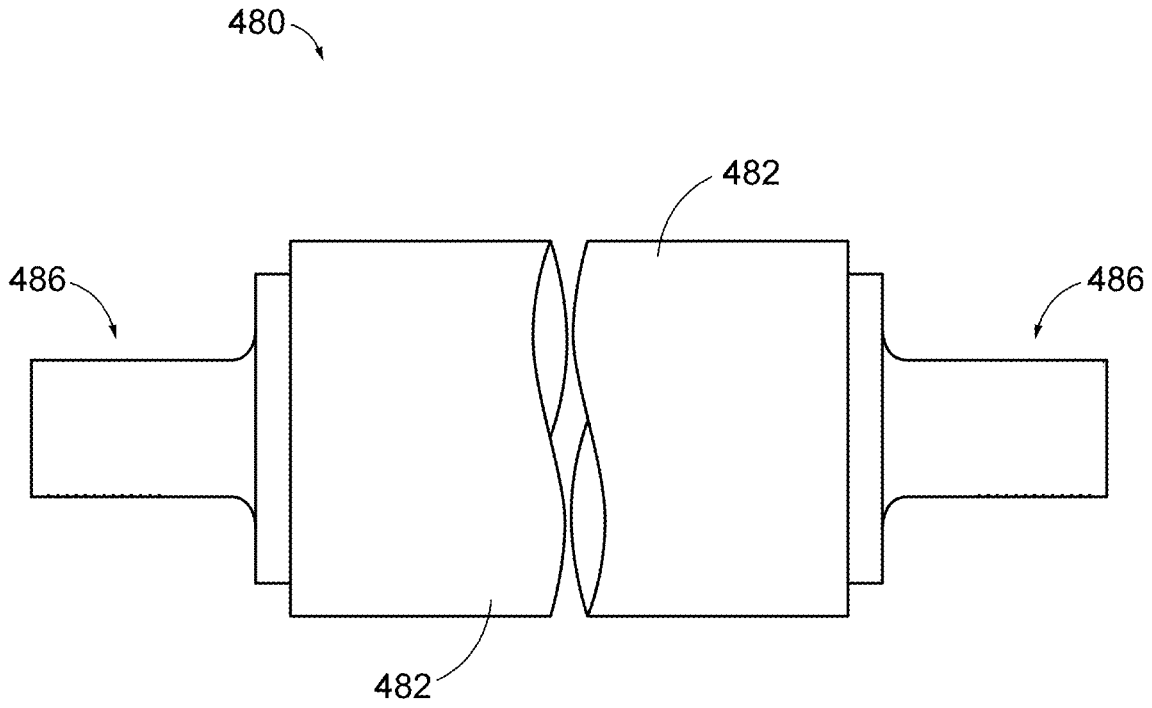
FIG. 14 depicts a front elevational view of a roll of the roll assembly of FIG. 12.

As shown in FIG. 14, roll (480) comprises a roll portion (482) and a journal (486) extending from each side of roll portion (482). Generally, roll portion (482) and journal (486) comprise steel or another metallic alloy. In some versions, roll (480) may be formed from a composite or other suitable material. Roll portion (482) comprises a generally elongate cylindrical shape. The cylindrical shape of roll portion (482) is generally configured to receive steel sheet (60) to permit at least a portion of steel sheet (60) to wrap around at least a portion of roll portion (482).

As described above, each journal (486) extends outwardly from roll portion (482). Each journal (486) comprises a generally cylindrical shape with an outer diameter that is less than the outer diameter defined by roll portion (482). In the present embodiment, each journal (486) comprises a substantially continuous smooth outer surface such that the outer surface of each journal (486) is free from a mechanical locking feature to maintain a substantially circular profile about the outer circumference of each journal (486) along the length of each journal (486). A substantially smooth outer surface of journal (486) may thereby be more cost effective to manufacture than a journal including a locking feature. Each journal (486) is sized to be received by bore (476) of a respective bearing block (472). However, as will be described in greater detail below, each journal (486) is generally undersized relative to bore (476) of bearing block (472) to permit space for roller sleeve (490) disposed between bearing bock (472) and journal (486).

Figure 15:
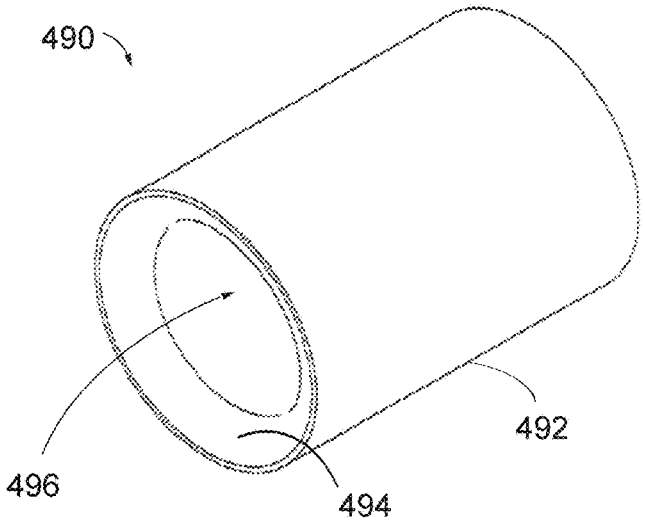
FIG. 15 depicts a perspective view of a roller sleeve of the roll assembly of FIG. 12.
Figure 16:
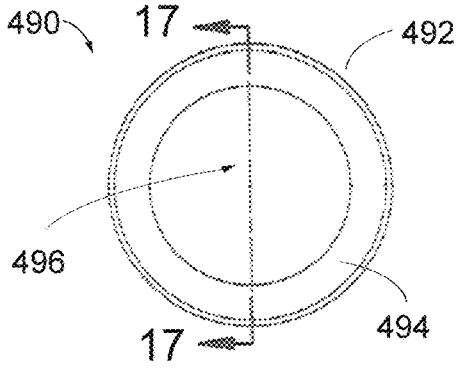
FIG. 16 depicts a front view of the roller sleeve of FIG. 15.
Figure 17:
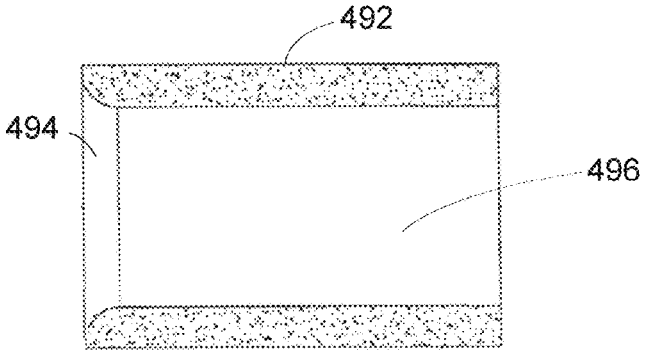
FIG. 17 depicts a cross-sectional view of the roller sleeve of FIG. 15 taken along line 17-17 of FIG. 16.

An illustrative roller sleeve (490) is shown in FIGS. 15-17. Roller sleeve (490) is generally configured to provide a durable non-reactive barrier between a respective journal (486) and a respective bearing bock (472). As can be seen, roller sleeve (490) comprises a generally cylindrical body (492) defining a cylindrical bore (496) extending through roller sleeve (490). The interior of bore (496) of the present embodiment comprises a substantially continuous smooth interior surface such that the inner surface of each bore (496) is free from a mechanical locking feature to maintain a substantially circular profile about the inner circumference of each bore (496) along the length of each bore (496). A smooth inner surface of bore (496) may thereby be more cost effective to manufacture than a bore including a locking feature. The inner diameter of bore (496) generally corresponds to the outer diameter of each journal (486) as will be discussed further below in more detail. Accordingly, roller sleeve (490) is positioned about journal (486) such that journal (486) is received within bore (496) of roller sleeve (490). The fit between each journal (486) and corresponding bore (496) and the weight of each journal (486) causes roller sleeve (490) to generally rotate simultaneously with journal (486) even though journal (486) and roller sleeve (490) are not mechanically coupled with a locking mechanism. This allows roller sleeve (490) to rotate within bearing block (472) relative to bearing block (472) to prevent wear to journal (486).

At least one side of body (492) of roller sleeve (490) may include a chamfered or beveled edge (494). Edge (494) is generally configured to abut an interface between a respective journal (486) and roll portion (482). Although edge (494) is shown has having a generally chamfered or beveled shape, it should be understood that any other suitable shape may be used such as a fillet shape, a squared shape, a j-groove, or etc.

Bearing block (472) and roller sleeve (490) may be made from ceramic. For instance, bearing block (472) and roller sleeve (490) may each comprise a refractory ceramic material having impact, abrasion, and/or thermal shock resistance. Such a refractory material may comprise silicon carbide (SiC), alumina ($Al_2O_3$), fused silica ($SiO_2$), or combinations thereof. In some versions, the refractory ceramic material comprises between about 5% and about 100% silicon carbide and/or alumina.

By way of example only, suitable refractory ceramic materials may include a class of ceramics known as SiAlON ceramics. SiAlON ceramics are high-temperature refractory materials that may be used in handling molten metal. SiAlON ceramics generally exhibit good thermal shock resistance, high strength at high temperatures, exceptional resistance to wetting by molten aluminum, and high corrosion resistance in the presence of molten metals. Such a SiAlON ceramic may comprise CRYSTON CN178 manufactured by Saint-Gobain High-Performance Refractories of Worcester, Mass., although numerous SiAlON class ceramics may be used.

Other suitable refractory ceramic materials may include a ceramic having about 73% $Al_2O_3$ and about 8% SiC. This ceramic may comprise GemStone® 404A manufactured by Wahl Refractory Solutions of Fremont, Ohio. In another embodiment, a harder ceramic having a greater amount of SiC, such as about 70% SiC, may be used. In some versions, stainless steel wire needles may be added to the ceramic material, such as about 0.5% to about 30% by weight of the material. Such a ceramic may comprise ADVANCER® nitride bonded silicon carbide manufactured by Saint-Gobain Ceramics of Worcester, Mass. or Hexology® silicon carbide also manufactured by Saint-Gobain Ceramics of Worcester, Mass. Still other suitable refractory materials will be apparent to one with ordinary skill in the art in view of the teachings herein.

Each bearing block (472) and/or roller sleeve (490) may be made by casting the refractory ceramic material. In some other versions, bearing block (472) and/or roller sleeve (490) may be made by pouring liquid ceramic into a mold and using heat to bake the ceramic to remove moisture. An outer surface of the bearing block (472) and/or roller sleeve (490) may then be grinded to provide a smooth outer surface. Still other suitable methods for making the components of roll assembly (480) will be apparent to one with ordinary skill in the art in view of the teachings herein.

Accordingly, bearing blocks (472) and roller sleeve (490) may be made from the same refractory material or from different refractory materials. In one embodiment, bearing block (472) comprises a castable ceramic having about 73% $Al_2O_3$ and about 8% SiC, such as GemStone® 404A, while roller sleeve (490) may comprise a harder ceramic having a greater amount of SiC, such as about 70% SiC. Such a ceramic may comprise ADVANCER® nitride bonded silicon carbide. This may allow bearing block (472) to wear before roller sleeve (490). This may be desirable because it may be more cost effective to replace bearing block (472) relative to roller sleeve (490). In some other versions, bearing block (472) may comprise ADVANCER® ceramic and/or roller sleeve may comprise GemStone® 404A ceramic.

Figure 18:
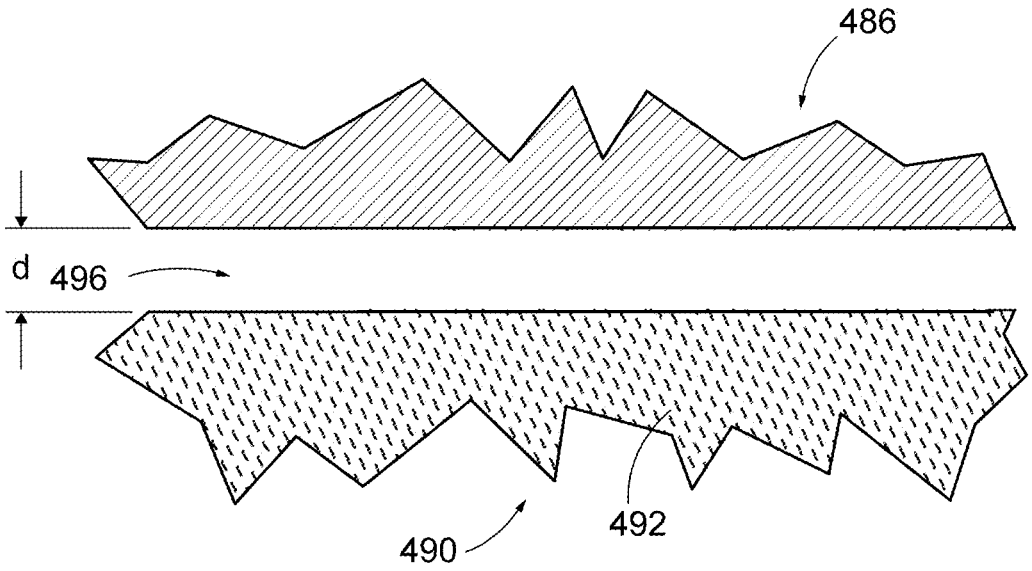
FIG. 18 depicts a partial front cross-sectional view of a coupling between the roll of FIG. 14 and the roller sleeve of FIG. 15.
Figure 19:
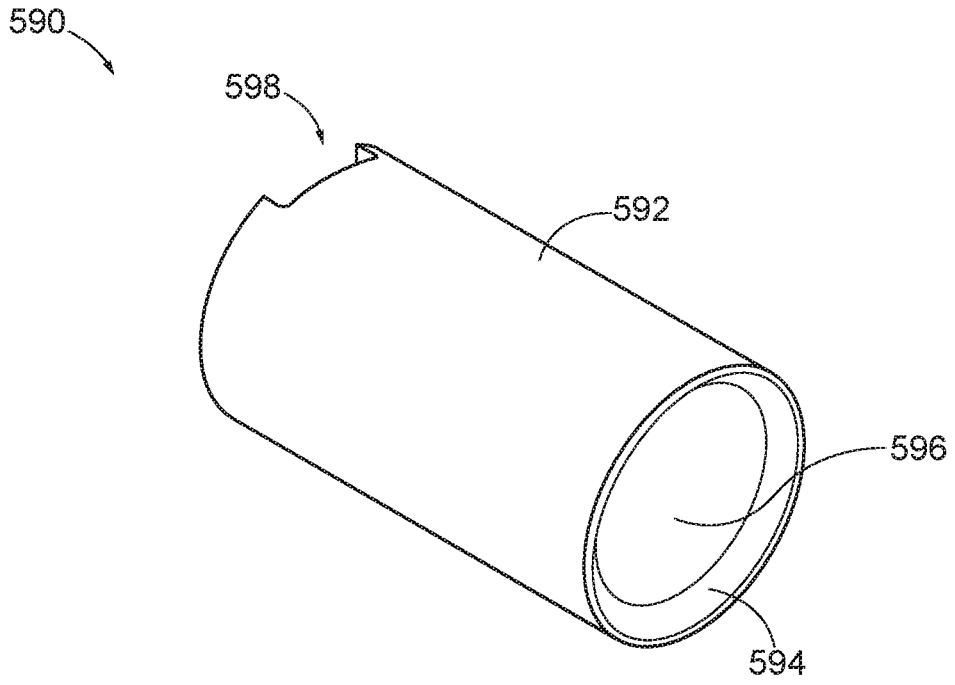
FIG. 19 depicts a perspective view of another roller sleeve that may be readily incorporated into the roll assembly of FIG. 12.
Figure 20:
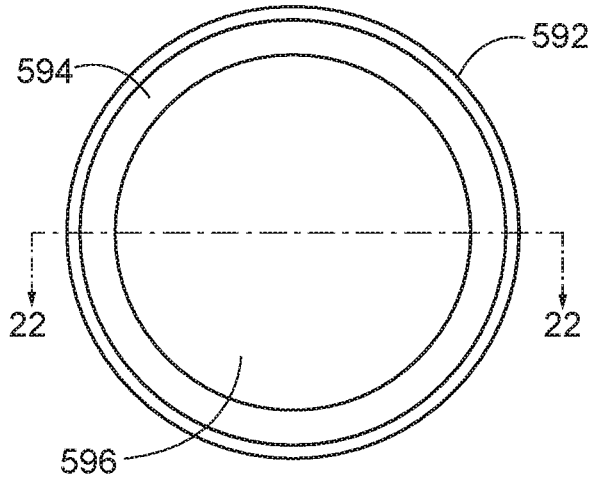
FIG. 20 depicts a front view of the roller sleeve of FIG. 19.
Figure 21:
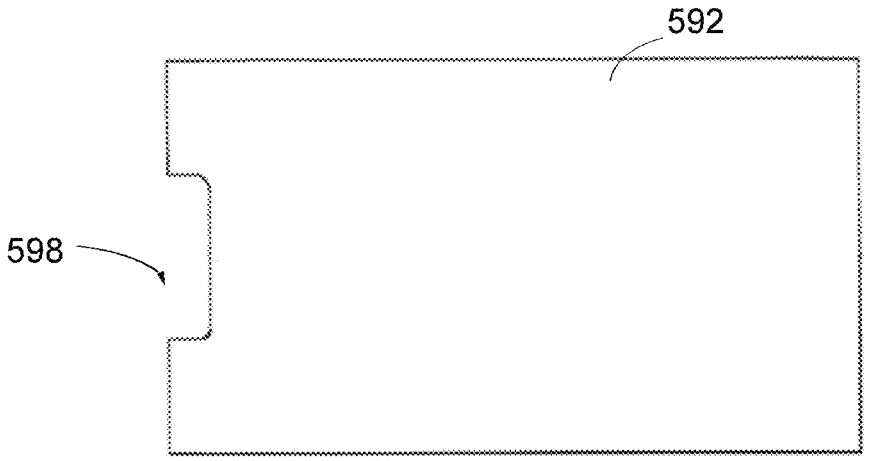
FIG. 21 depicts a top elevational view of the roller sleeve of FIG. 19.
Figure 22:
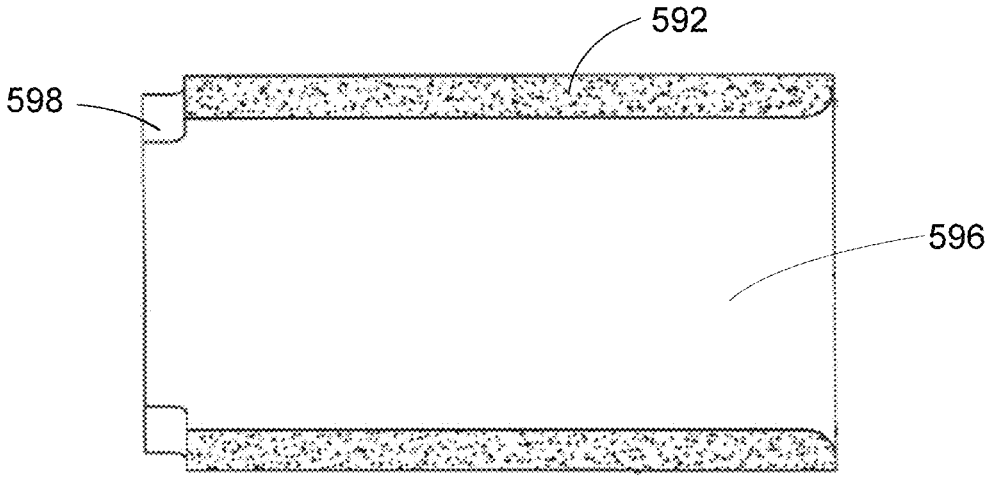
FIG. 22 depicts a cross-sectional view of the roller sleeve of FIG. 19 taken along line 22-22 of FIG. 20.

Accordingly, roller sleeve (490) may be positioned between a journal (486) and a bearing block (472) to provide a durable non-reactive barrier between the respective journal (486) and the respective bearing bock (472). Referring to FIG. 18, the present example includes a predetermined clearance (d) between the inner diameter of bore (496) and the outer diameter of journal (486). Initially, it was theorized that this clearance (d) could be derived from the difference between the thermal expansion ratio of journal (486) and the thermal expansion ratio of roller sleeve (490) such that once both journal (486) and roller sleeve (490) approach the temperature of dip tank (20), this clearance (d) would be substantially eliminated. However, in the present example, the clearance (d) between bore (496) and journal (486) is unexpectedly not exclusively tied to the thermal expansion ratios of journal (486) and roller sleeve (490). In particular, it has been found that some clearance (d) between journal (486) and roller sleeve (490) at the temperature of hot dip tank (20) is beneficial to improving the durability of roller sleeve (490) during the coating procedure. Thus, it should be understood that in the present example at least some clearance (d) may be maintained between the inner diameter of bore (496) and the outer diameter of journal (486) throughout the coating procedure.

Although the clearance (d) between the inner diameter of bore (496) and the outer diameter of journal (486) referred to above is described as being beneficial for improving the durability of roller sleeve (490), it should be understood that this clearance (d) is also limited in the present example. For instance, if the clearance (d) between the inner diameter of bore (496) and the outer diameter of journal (486) is too significant, some wetting of the molten aluminum (22) may occur, thereby transporting molten metal (22) into the clearance (d) between the inner diameter of bore (496) and the outer diameter of journal (486). Although this may depend at least in part on the material of roller sleeve (490), it should be understood that in the present example the clearance (d) between the inner diameter of bore (496) and the outer diameter of journal (486) is limited so as to minimize or prevent transport of molten metal (22) into the clearance (d). The clearance (d) between bore (496) and journal (486) may also be limited to prevent slipping between roller sleeve (490) and journal (486) when roll (480) is rotated by friction between steel sheet (60) and roll portion (482).

Accordingly, the inner diameter of bore (496) of roller sleeve (490) is sized corresponding to the outer diameter of journal (486) to provide a clearance fit between journal (486) and roller sleeve (490). Such a clearance fit may have a minimum clearance (d) sufficient to prevent cracking of roller sleeve (490) upon thermal expansion of journal (486) and a maximum clearance (d) to prevent transport of molten metal (22) into the clearance (d) and/or to prevent slipping between roller sleeve (490) and journal (486). In some examples, a suitable clearance (d) at operating temperature may be between about 0.001 inches and 0.012 inches.

In an exemplary use, steel sheet (60) is wrapped about roll assembly (470). Friction between steel sheet (60) and roll portion (482) of roll (480) causes roll (480) to rotate as steel sheet (60) moves relative to roll assembly (470). Rotation of roll (480) causes corresponding rotation of each journal (486), which also causes rotation of each roller sleeve (490) via engagement between the substantially continuous smooth inner surface of bore (496) of roller sleeve (490) and the substantially continuous smooth outer surface of journal (486). Due to fit between each journal (486) and corresponding bore (496) and the weight of each journal (486), roller sleeve (490) generally rotates simultaneously with journal (486) even though journal (486) and roller sleeve (490) are not mechanically coupled with a locking mechanism. Still other suitable configurations for roller sleeve (490) and/or roll assembly (470) will be apparent to one with ordinary skill in the art in view of the teachings herein.

Figure 23:
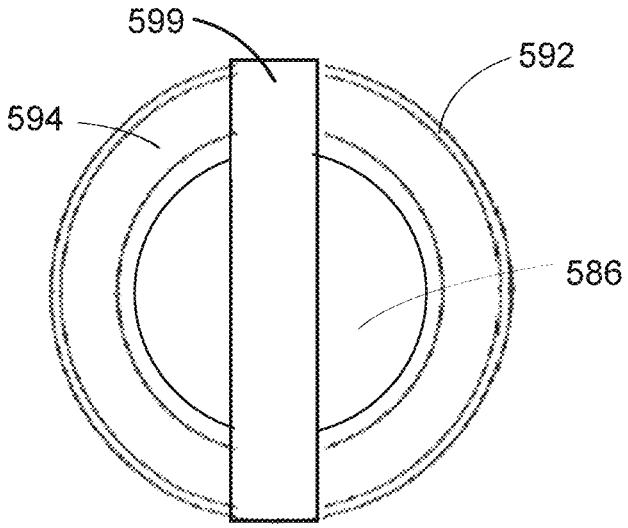
FIG. 23 depicts a front view of the roller sleeve of FIG. 19 assembled with a journal.

For instance, FIGS. 19-22 show another embodiment of a roller sleeve (590) that is similar to roller sleeve (490), except that roller sleeve (590) comprises a pair of notches (598) extending inwardly from a top and bottom portion of an end of roller sleeve (590). While the illustrated embodiment shows roller sleeve (590) comprising two notches (598) at a top and bottom portion of roller sleeve (590), roller sleeve (590) may comprise any suitable number of notches (598) positioned at any suitable position about roller sleeve (590). Accordingly, roller sleeve (590) may be assembled with a journal (586), as shown in FIG. 23, such that roller sleeve (590) is positioned about journal (586) with notches (598) at the free end of journal (586). A bar (599) may then be inserted within notches (598) of roller sleeve (590) along the free end of roller sleeve (590). Bar (599) may be fastened with the free end of journal (586) to thereby mechanically couple journal (586) with roller sleeve (590) via bar (599).

EXAMPLES

The following examples relate to various non-exhaustive ways in which the teachings herein may be combined or applied. It should be understood that the following examples are not intended to restrict the coverage of any claims that may be presented at any time in this application or in subsequent filings of this application. No disclaimer is intended. The following examples are being provided for nothing more than merely illustrative purposes. It is contemplated that the various teachings herein may be arranged and applied in numerous other ways. It is also contemplated that some variations may omit certain features referred to in the below examples. Therefore, none of the aspects or features referred to below should be deemed critical unless otherwise explicitly indicated as such at a later date by the inventors or by a successor in interest to the inventors. If any claims are presented in this application or in subsequent filings related to this application that include additional features beyond those referred to below, those additional features shall not be presumed to have been added for any reason relating to patentability.

A series of tests were performed to evaluate journal (86) and roller sleeve (90) described above to identify a desired clearance (d). This series of tests is detailed below in the following Examples. It should be understood that the following Examples are merely for illustrative purposes and that in other instances, various alternative characteristics may be used as will be understood by those of skill in the art in view of the teachings herein.

Example 1

In an initial test, a structure similar to journal (86) described above was tested to establish a measured coefficient of thermal expansion of the journal. The tested journal was prepared as a mockup portion of stab roll such that the journal consisted of the journal attached to a hub corresponding to an end of stab roll. While the journal was at room temperature (e.g., approximately 70° F.), measurements were acquired of all surfaces such as the outer diameter of the journal, the thread peaks, and the roots of the threads. The journal was subsequently heated to a temperature of 1,350° F. Immediately after heating, the same measurements were taken while the journal was in the heated condition. Measurements taken at room temperature were compared against measurements taken while the journal was in the heated condition. This comparison was then used to calculate an experimentally based coefficient of thermal expansion for the journal. Thus, the experimentally based coefficient of thermal expansion of the journal was calculated to be $9.1\times10^{-6}$ in/in/° F. Based on this calculation, it was hypothesized that a desirable clearance (d) between journal (86) and roller sleeve (90) would be approximately 0.020 in.

Example 2

In a second trial, the experimentally based coefficient of thermal expansion and corresponding hypothesized desirable clearance (d) between journal (86) and roller sleeve (90) (identified in EXAMPE 1) was tested for validation under operating temperatures. A roller sleeve similar to roller sleeve (90), described above, was provided by St. Gobain Ceramics. An inner diameter of the roller sleeve was tapered and included some burrs. In addition, the roller sleeve was slightly out of round. Nonetheless, testing proceeded.

Prior to testing, machining was performed on the journal. The journal was machined to adjust the clearance to at least 0.042" between the inner diameter of the roller sleeve and the outer diameter of the journal. This clearance was set to provide an approximate size-to-size fit between the journal and the roller sleeve at high temperature (e.g., 1,150° F.).

After machining, the roller sleeve and the journal were mated. After mating, it was observed that due to the out of round character of the roller sleeve, little to no clearance was present in some localized areas around the outer diameter of the journal. To improve the clearance and to provide an overall loose fit, the roller sleeve was unscrewed from the journal approximate ¼ turn. In this configuration, the roller sleeve and the journal were then subject to a furnace based heat treatment.

The heat treatment included heating the roller sleeve and the journal as mated to 1,150° F. in 150° F. per hour intervals. The assembly of the roller sleeve and the journal was removed from the furnace at 500° and 900° F. to observe the clearance. At 500° F., it was observed that there was "still plenty of clearance" after tapping the assembly with a 4 inch×4 inch elongate wood block. At 900° F., it was observed that no clearance was visibly detectable. In addition, it was observed that the roller sleeve had chipped and formed a visible crack. At this stage, it was hypothesized that chipping and cracking might be avoided by reducing another 0.030 in. to 0.040 in. from the outer diameter of the journal.

After completion of the heat treatment, additional chips in the roller sleeve were observed. This testing suggested that the clearance was necessary to aid installation and to avoid any possibility of roller sleeve fracture during operation. In addition, it was further hypothesized that the durability of the roller sleeve might be improved by machining the threads of the roller sleeve or the journal for engagement of only ½ of the thread depth. At the time of testing, thread depth was 0.200". Thus, applying the hypothesized reduction in thread depth, additional durability of the roller sleeve might be achieved by having only 0.100" of the threads engage with each other. Based on this, it was suggested that up to 0.060" of material might be removed from both threads of the roller sleeve and the journal to provide a desired fit.

Example 3

After the trial described above in Example 2, an in situ trial was conducted. For this in situ trial, a stab roll assembly similar to stab roll assembly (70) described above was prepared. Like with stab roll assembly (70), the stab roll assembly included two journals. However, the two journals were prepared such that one journal was configured as a control journal and another journal was configured as a test journal. The control journal was prepared in accordance with standard practices such that a metal journal to bearing block configuration was formed via control journal. The test journal was prepared as similarly described above with respect to journal (86) and included a roller sleeve similar to roller sleeve (90) described above.

The test journal and corresponding roller sleeve were both configured to provide a maximum clearance of 0.220" between the test journal and corresponding roller sleeve. It was hypothesized that a size-to-size fit between the journal and the roller sleeve during operation at temperature was not necessary and could be detrimental. Instead, it was hypothesized that force exerted upon the stab roll during operation would only require a single side of the threads of the journal to engage the threads of the roller sleeve. In other words, only ½ engagement of the threads was to be required in total because full engagement might occur on one side of the journal and limited engagement might occur on the other side of the journal. However, some limit to the clearance was still desirable to support the load present during the operation of the stab roll assembly. In addition, some limit to the clearance was still desirable to avoid penetration of molten aluminum between the journal and the roller sleeve. Thus, the test journal and corresponding roller sleeve were both configured to provide a max clearance of 0.220 in. Prior to test initiation a portion of the roller sleeve was chipped. Thus, the roller sleeve only partially covered the test journal throughout the test.

The stab roll assembly was then inserted into a molten aluminum bath for use in aluminizing steel sheet. A total of 583,521 ft. of steel sheet was processed with the stab roll assembly in service. Upon removal of the stab roll assembly, fracture on the exterior of the bearing block was visible. Upon removal of bearing block from the stab roll fixture, the bearing block separated into four separate parts. Upon separation, each fracture surface was completely coated with aluminum metal. This coating pattern suggested that fracture of the bearing block occurred during service rather than during cooling via thermal shock. A large void was present in two mating fracture surfaces. Thus, the cracking of the bearing block was determined to be unrelated to the use of the roller sleeve and test journal combination.

The roller sleeve exhibited limited visible wear as indicated by no grooving and generally limited loss of thickness. The portion of the roller sleeve that was chipped prior to testing exhibited some increase in chipped area. However, the chipping did not spread along the length of the roller sleeve and did not affect the roller sleeve serviceability. In comparison to the control journal, the roller sleeve exhibited generally less wear, with the control journal exhibiting more typical wear. In quantitative terms, the wear rate of the roller sleeve was decreased substantially in comparison to the wear rate of the control journal based on comparisons between inner diameter measurements of the bearing blocks (before and after testing), the outer diameter of the control journal, and general observations with respect to wear appearance.

Example 4

Another journal similar to journal (86) described above has been prepared. The journal has been prepared to provide a clearance of 0.220 in.+0 in./0.005 in. when coupled to a roller sleeve similar to roller sleeve (90) described above. The threads on the journal were machined to provide rounded peaks to better accommodate irregular inner diameter geometry provided by the roller sleeve. Measurements of lateral movement between the journal and the roller sleeve have been acquired. This measurement resulted in 0.020 in. to 0.040 in. lateral movement with as much as 0.060 in. to 0.155 in. considered to be acceptable.

Example 5

A roll assembly similar to roll assembly (470) described above was prepared to perform an in situ trial. Like with roll assembly (470), the roll assembly included two journals, each having a roller sleeve similar to roller sleeve (490) described above. In the trial, the roller sleeve was made from ADVANCER® material and the bearing block was made from GemStone® 404A material. Each journal and corresponding roller sleeve were both configured to provide a maximum clearance of 0.040" between the journal and corresponding roller sleeve at the hot dip tank temperature. The roll assembly was then preheated and inserted into a molten aluminum bath for use in aluminizing steel sheet for a period of 5 days 12 hours and ran 1.9 MM feet of steel. Upon removal of the stab roll assembly, it was found that the journals spun within the corresponding roller sleeves indicating that there was too much clearance between the journal and roller sleeve.

Example 6

A roll assembly similar to roll assembly (470) described above was prepared to perform another in situ trial. Like with roll assembly (470), the roll assembly included two journals, each having a roller sleeve similar to roller sleeve (490) described above. In the trial, the roller sleeve was made from ADVANCER® material and the bearing block was made from GemStone® 404A material. Each journal and corresponding roller sleeve were both configured to provide a maximum clearance of 0.006" between the journal and corresponding roller sleeve at operating temperature. The roll assembly was then preheated and inserted into a molten aluminum bath for use in aluminizing steel sheet. A total of 733,895 ft. of steel sheet was processed with the roll assembly in service. Upon removal of the roll assembly, there was found to be minimal wear on each bearing block, with 0.140 in. of wear on block 1 and 0.085 in. of wear on block 2. There was also minimal wear on each roller sleeve, with 0.005 in. of diameter removed on sleeve 1 and 0.024 in. of diameter removed on sleeve 2. Each roller sleeve was easily removed from the corresponding journal with light tapping from a hammer. While there were no signs of rotation of the journal within roller sleeve 1, there were signs of slight rotation of the journal within roller sleeve 2 indicating that there may too much clearance between the journal and roller sleeve.

Example 7

A roll assembly similar to roll assembly (470) described above was prepared to perform another in situ trial. Like with roll assembly (470), the roll assembly included two journals, each having a roller sleeve similar to roller sleeve (490) described above. In the trial, the roller sleeve was made from ADVANCER® material and the bearing block was made from GemStone® 404A material. Each journal and corresponding roller sleeve were both configured to provide a maximum clearance of 0.004 inches between the journal and corresponding roller sleeve at operating temperature. The roll assembly was then preheated and inserted into a molten aluminum bath for use in aluminizing steel sheet for a period of 7 days and ran 3 MM feet of steel. The trial was considered to be successful.

Example 8

A roll assembly similar to roll assembly (470) described above was prepared to perform another in situ trial. Like with roll assembly (470), the roll assembly included two journals, each having a roller sleeve similar to roller sleeve (490) described above. In the trial, the roller sleeve was made from ADVANCER® material and the bearing block was made from GemStone® 404A material. Each journal and corresponding roller sleeve were both configured to provide a maximum clearance of 0.004 inches between the journal and corresponding roller sleeve at operating temperature. The roll assembly was then preheated and inserted into a molten aluminum bath for use in aluminizing steel sheet for a period of 7 days and ran 3 MM feet of steel. Upon removal of the roll assembly, one of the roller sleeves was in good condition with a loss of diameter of about 0.021 in. The trial was considered to be successful.

Example 9

A roll assembly similar to roll assembly (470) described above was prepared to perform another in situ trial. Like with roll assembly (470), the roll assembly included two journals, each having a roller sleeve similar to roller sleeve (490) described above. In the trial, the roller sleeve was made from ADVANCER® material and the bearing block was made from GemStone® 404A material. Each journal and corresponding roller sleeve were both configured to provide a maximum clearance of 0.004 inches between the journal and corresponding roller sleeve at operating temperature. The roll assembly was then preheated and inserted into a molten aluminum bath for use in aluminizing steel sheet for a period of 4 days and 23.5 hours and ran 2.3 MM feet of steel. The trial was considered to be successful. Both roller sleeves remained intact and the journals did not rotate within the roller sleeves. Upon removal of the roll assembly, the wear rate on the roller sleeves was determined to be 0.010 inches per MM feet of strip. The calculated wear rate on the bearing blocks was determined to be 0.04 in. to 0.09 in. per MM feet of strip.

Example 10

In a heat expansion trial, a roller sleeve, similar to roller sleeve (490) described above, was positioned over a journal at room temperature to provide a clearance of about 0.027 in. In the trial, the roller sleeve was made from ADVANCER® material and the journal was made from steel. The roller sleeve and journal were then heated to 1300° F. at a heat rate less than 100° F. per hour. After four hours of soak time, the roller sleeve was visually inspected to determine that there were no cracks in the roller sleeve. The roller sleeve and journal where then heated to 1350° F. with a soak time of 2 hours. The roller sleeve was visually inspected to determine that there were no cracks in the roller sleeve. This process was repeated at 1400° F., 1450° F., 1550° F., etc. up to 1700° F. No cracks in the roller sleeve were observed during the trial. It was thereby determined that the thermal expansion between the journal and the roller sleeve with such materials and clearance did not cause failure of the roller sleeve.

Example 11

A roller assembly, wherein the roller assembly is configured for submersion in molten metal, wherein the roller assembly comprises: (a) a roller comprising a roll portion and at least one journal extending axially from the roll portion, wherein the at least one journal is substantially cylindrical; (b) a roller sleeve comprising a bore extending through the roller sleeve, wherein the roller sleeve is substantially cylindrical, wherein the roller sleeve is positioned about the journal; and (c) a bearing block defining an opening therein, wherein the roller sleeve is disposed within the opening of the bearing block between the bearing block and the at least one journal.

Example 12

The roller assembly of example 11, wherein the roller sleeve and the at least one journal are configured to rotate together relative to the bearing block.

Example 13

The roller assembly of example 11 or 12, wherein the bore of the roller sleeve is sized to provide a clearance fit between an inner surface of the bore and an outer surface of the at least one journal.

Example 14

The roller assembly of example 13, wherein the clearance fit is maintained when the roller assembly is submersed in molten metal.

Example 15

The roller assembly of examples 13 or 14, wherein the clearance fit is sized to prevent ingress of molten metal between the roller sleeve and the at least one journal.

Example 16

The roller assembly of any of the examples 11 to 15, wherein the roller sleeve comprises a ceramic material.

Example 17

The roller assembly of example 16, wherein the ceramic material comprises silicon carbide.

Example 18

The roller assembly of any of the examples 11 to 17, wherein the bearing block comprises a ceramic material.

Example 19

The roller assembly of example 18, wherein the ceramic material comprises silicon carbide.

Example 20

A roller assembly, wherein the roller assembly is configured for submersion in molten metal, wherein the roller assembly comprises: (a) a roller comprising a roll portion and two journals protruding from opposite ends of the roll portion, wherein each journal comprises a substantially continuous smooth outer surface; (b) a pair of roller sleeves, wherein each roller sleeve comprises a bore extending through the roller sleeve configured to receive a corresponding journal therein, wherein the bore of each roller sleeve comprises a substantially continuous smooth inner surface; and (c) a pair of bearing blocks, wherein each bearing block defines an opening therein, wherein the opening of each bearing block is configured to receive a corresponding roller sleeve with a corresponding journal disposed within the roller sleeve.

Example 21

The roller assembly of example 20, wherein the bore of each roller sleeve is sized to provide a clearance between the inner surface of the bore and the outer surface of the corresponding journal.

Example 22

The roller assembly of example 21, wherein the clearance is maintained when the roller assembly is submersed in molten metal.

Example 23

The roller assembly of example 21 or 22, wherein the clearance is sized to prevent ingress of molten metal between the roller sleeve and the corresponding journal.

Example 24

The roller assembly of any of the examples 21 to 23, wherein the clearance is between about 0.001 inches and 0.012 inches.

Example 25

The roller assembly of any of the examples 20 to 24, wherein each roller sleeve is ceramic.

Example 26

The roller assembly of example 25, wherein the ceramic of each roller sleeve comprises at least about 5% silicon carbide.

Example 27

The roller assembly of any of the examples 20 to 26, wherein each bearing block is ceramic.

Example 28

The roller assembly of example 27, wherein the ceramic of each bearing block comprises at least about 5% silicon carbide.

Example 29

The roller assembly of any of the examples 20 to 28, wherein each roller sleeve comprises a greater amount of silicon carbide than each bearing block.

Example 30

A method of operating a roller assembly in a steel coating line comprising the steps of: positioning a journal of a roller within a bore of a ceramic roller sleeve, wherein an outer surface of the journal is substantially smooth, wherein an inner surface of the bore of the roller sleeve is substantially smooth; positioning the roller sleeve within an opening of a ceramic bearing block; and rotating the journal and roller sleeve together within the bearing block.

Having shown and described various embodiments of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, embodiments, geometrics, materials, dimensions, ratios, steps, and the like discussed above are illustrative and are not required. Accordingly, the scope of the present invention should be considered in terms of any claims that may be presented and is understood not to be limited to the details of structure and operation shown and described in the specification and drawings.

What is claimed is:

1. A roller assembly, wherein the roller assembly is configured for submersion in molten metal, wherein the roller assembly comprises:

(a) a roller comprising a roll portion and at least one journal extending axially from the roll portion, wherein the at least one journal is substantially cylindrical;

(b) a roller sleeve comprising a bore extending through the roller sleeve, wherein the bore of the roller sleeve is substantially cylindrical, wherein the roller sleeve is positioned about the at least one journal, wherein an inner surface of the bore of the roller sleeve is sized to define a clearance fit with an outer surface of the at least one journal such that the clearance fit between the bore of the roller sleeve and the at least one journal is sized to cause the roller sleeve to rotate simultaneously with the at least one journal and to inhibit slipping between the roller sleeve and the at least one journal when the roller sleeve and the at least one journal are rotated; and (c) a bearing block defining an opening therein, wherein the roller sleeve is disposed within the opening of the bearing block between the bearing block and the at least one journal.

2. The roller assembly of claim 1, wherein the clearance fit is maintained when the roller assembly is submersed in molten metal.

3. The roller assembly of claim 1, wherein the clearance fit is sized to prevent ingress of molten metal between the roller sleeve and the at least one journal.

4. The roller assembly of claim 1, wherein the roller sleeve comprises a ceramic material.

5. The roller assembly of claim 4, wherein the ceramic material comprises silicon carbide.

6. The roller assembly of claim 1, wherein the bearing block comprises a ceramic material.

7. The roller assembly of claim 6, wherein the ceramic material comprises silicon carbide.

8. A roller assembly, wherein the roller assembly is configured for submersion in molten metal, wherein the roller assembly comprises:

(a) a roller comprising a roll portion and two journals protruding from opposite ends of the roll portion, wherein each journal comprises a substantially continuous smooth outer surface along a length of each journal to define a first coupling surface;

(b) a pair of roller sleeves, wherein each roller sleeve comprises a bore extending through the roller sleeve configured to receive a corresponding journal therein, wherein the bore of each roller sleeve comprises a substantially continuous smooth inner surface along of a length of each roller sleeve to define a second coupling surface, wherein the first and second coupling surfaces are aligned with each other to provide an interface between the first and second coupling surfaces to cause the roller sleeve and the corresponding journal to rotate together; and (c) a pair of bearing blocks, wherein each bearing block defines an opening therein, wherein the opening of each bearing block is configured to receive a corresponding roller sleeve with a corresponding journal disposed within the roller sleeve.

9. The roller assembly of claim 8, wherein the interface between the first and second coupling surfaces is sized to provide a clearance between the first and second coupling surfaces.

10. The roller assembly of claim 9, wherein the clearance is maintained when the roller assembly is submersed in molten metal.

11. The roller assembly of claim 10, wherein the clearance is sized to prevent ingress of molten metal between the roller sleeve and the corresponding journal.

12. The roller assembly of claim 9, wherein the clearance is between about 0.001 inches and 0.012 inches.

13. The roller assembly of claim 9, wherein each roller sleeve is ceramic.

14. The roller assembly of claim 13, wherein the ceramic of each roller sleeve comprises at least about 5% silicon carbide.

15. The roller assembly of claim 13, wherein each bearing block is ceramic.

16. The roller assembly of claim 15, wherein the ceramic of each bearing block comprises at least about 5% silicon carbide.

17. The roller assembly of claim 15, wherein each roller sleeve comprises a greater amount of silicon carbide than each bearing block.

* * * * *